US006165663A

United States Patent [19]

Baba et al.

[11] Patent Number: 6,165,663

[45] Date of Patent: Dec. 26, 2000

[54] MAGNETIC COATED CARRIER TWO-COMPONENT TYPE DEVELOPER AND DEVELOPING METHOD

[75] Inventors: Yoshinobu Baba, Yokohama; Takeshi Ikeda, Shizuoka-ken; Yuko Sato, Numazu; Hitoshi Itabashi; Yuzo Tokunaga, both of Yokohama, all of Japan

[73] Assignee: Canon Kabushiki Kaisha, Tokyo, Japan

[21] Appl. No.: 09/422,105

[22] Filed: Oct. 20, 1999

Related U.S. Application Data

[63] Continuation-in-part of application No. 08/826,684, Apr. 7, 1997, abandoned.

[30] Foreign Application Priority Data

Apr. 8, 1996 [JP] Japan ..... 8-085240

[51] Int. Cl.[7] ..... G03G 9/107; G03G 13/09

[52] U.S. Cl. ..... 430/106.6; 430/108; 430/111; 430/122

[58] Field of Search ..... 430/106.6, 108, 430/111, 122

[56] References Cited

U.S. PATENT DOCUMENTS

| | | | |
|---|---|---|---|
| 3,666,363 | 5/1972 | Tanaka et al. | 430/117 |
| 4,071,361 | 1/1978 | Marushima | 430/98 |
| 5,439,771 | 8/1995 | Baba et al. | 430/106.6 |
| 5,565,291 | 10/1996 | Mayama et al. | 430/106.6 |
| 5,573,880 | 11/1996 | Mayama et al. | 430/106.6 |
| 5,576,133 | 11/1996 | Baba et al. | 430/106.6 |
| 5,624,778 | 4/1997 | Sato et al. | 430/106.6 |
| 5,659,857 | 8/1997 | Yamazaki et al. | 430/111 |
| 5,712,069 | 1/1998 | Baba et al. | 430/106.6 |
| 6,010,811 | 1/2000 | Baba et al. | 430/106.6 |

FOREIGN PATENT DOCUMENTS

| | | |
|---|---|---|
| 0650099 | 4/1995 | European Pat. Off. . |
| 0693712 | 1/1996 | European Pat. Off. . |
| 0704767 | 4/1996 | European Pat. Off. . |
| 0708379 | 4/1996 | European Pat. Off. . |
| 59-8827 | 2/1984 | Japan . |
| 62-61948 | 2/1987 | Japan . |
| 5-8424 | 1/1993 | Japan . |
| 5-100494 | 4/1993 | Japan . |
| 6-118725 | 4/1994 | Japan . |

OTHER PUBLICATIONS

Database, WPI, Section Ch, Week 8229, Derwent Pub., Class A89, AN 82–60146E, XP002035819.

Database WPI, Section Ch, Week 9342, Derwent Pub., Class A89, An93–33076, XP002035820.

*Primary Examiner*—Roland Martin

*Attorney, Agent, or Firm*—Fitzpatrick, Cella, Harper & Scinto

[57] ABSTRACT

A magnetic coated carrier suitable for constituting a two-component type developer for use in electrophotography is composed of magnetic coated carrier particles comprising magnetic coated carrier particles comprising magnetic carrier core particles each comprising a binder resin and metal oxide particles, and a coating layer surface-coating each carrier core particle. The metal oxide particles have been subjected to a surface lipophilicity-imparting treatment. The magnetic carrier core particles have a resistivity of at least $1\times10^{10}$ ohm.cm, and the magnetic coated carrier has a resistivity of at least $1\times10^{12}$ ohm.cm. The magnetic coated carrier has a particle size distribution such that (i) it has a number-average particle size Dn of 5–100 $\mu$m, (ii) it satisfies a relationship of $Dn/\sigma \geqq 3.5$, wherein $\sigma$ denotes a standard deviation of number-basis particle size distribution of the carrier, and (iii) it contains at most 25% by number of particles having particle sizes of at most $Dn\times2/3$.

89 Claims, 3 Drawing Sheets

$$Ra = \frac{1}{\ell}\int_0^{\ell} |f(x)|\,dx$$

$$Sm = \frac{1}{n}\sum_{i=1}^{n} Smi$$

MAGNETIC COATED CARRIER TWO-COMPONENT TYPE DEVELOPER AND DEVELOPING METHOD

This Appln is a C-I-P of Ser. No. 08/826,684 filed Apr. 7, 1997 Abnd.

FIELD OF THE INVENTION AND RELATED ART

The present invention relates to a magnetic carrier for constituting a developer, a two-component type developer and a developing method for use in an image forming method, such as electrophotography and electrostatic recording.

Hitherto, various electrophotographic processes have been disclosed in U.S. Pat. Nos. 2,297,691; 3,666,363; 4,071,361; etc. In these processes, an electrostatic latent image is formed on a photoconductive layer by irradiating a light image corresponding to an original, and a toner is attached onto the latent image to develop the latent image. Subsequently, the resultant toner image is transferred onto a transfer material such as paper, via or without, an intermediate transfer member, and then fixed e.g., by heating, pressing, or heating and pressing, or with solvent vapor, to obtain a copy or a print.

In recent years, along with development of computers and multi-media, there have been desired means for outputting further higher-definition full color images in wide fields from offices to home. Heavy users generally require high durability or continuous image forming performance free from image quality deterioration even in a continuous copying or printing on a large number of sheets, and users in small offices or at home may require, in addition to high image quality, economization of space and energy which in turn requires apparatus size reduction, a system allowing re-utilization of toner or a waste toner-less (or cleaner-less) system, and a lower temperature fixation. Various studies have been made from various viewpoints for accomplishing these objects.

In the electrostatic (latent) image development step, charged toner particles are attached to an electrostatic (latent) image by utilizing electrostatic interaction with the electrostatic latent image, thereby forming a toner image. Among known developing methods using a toner for developing electrostatic images, the method using a two-component type developer comprising a mixture of a toner and a carrier has been suitably used in full-color copying machines and full-color printers requiring especially high image quality.

As the magnetic carrier used in the two-component type developer, there have been commercialized iron powder carrier, ferrite carriers and magnetic material-dispersed resin carriers. An iron powder carrier, because of its low resistivity, can cause a leakage of charge from an electrostatic image via the carrier to disturb the electrostatic image, thus resulting in image defects. Even a ferrite carrier having a relatively high resistivity can fail in preventing charge leakage from an electrostatic image via the carrier in some cases, especially in a developing method including application of an alternating electric field. Further, as the carrier has a large saturation magnetization, the magnetic brush is liable to be rigid, thus being liable to leave a trace caused by the magnetic brush in the resultant and toner image.

In order to obviate the above-mentioned problems, there has been proposed a magnetic material-dispersed resin carrier wherein magnetic fine particles are dispersed in a binder resin. The magnetic material-dispersed resin carrier, compared with a ferrite carrier, has a relatively high resistivity, a small saturation magnetization and a small true specific gravity, so that the magnetic brush of the carrier is less rigid and can provide good toner images free from traces caused by the magnetic brush.

However, in the case of using a magnetic material-dispersed resin carrier, because of its low saturation magnetization, the carrier is liable to cause carrier attachment. Further, if the carrier particle size is reduced along with the use of a smaller particle size toner, the carrier is liable to have a lower charge-imparting ability to a toner and result in a developer of a lower flowability.

In order to obviate the problems, JP-A 7-43951 has proposed a magnetic material-dispersed resin carrier having a prescribed particle size distribution. The JP publication discloses a resin carrier production process wherein a magnetic material is kneaded together with a binder resin for dispersion, and the kneaded product after cooling is pulverized and classified, wherein the pulverization is improved to provide a sharp particle size distribution so as to solve the above problems. However, it is sometimes difficult to remove an ultra-fine powder fraction from the classified carrier product, thus causing carrier attachment. The magnetic material-dispersed resin carrier prepared through the process is applicable to a monochromatic image formation but there is room for further improvement when it is applied to a full-color copying machine or a full-color printer requiring a high degree of color reproducibility.

SUMMARY OF THE INVENTION

A generic object of the present invention is to provide a magnetic coated carrier, a two-component type developer and a developing method using such a two-component type developer, having solved the above-mentioned problems.

A more specific object of the present invention is to provide a magnetic coated carrier capable of exhibiting an excellent toner-chargeability especially in combination with a small-particle size toner and free from carrier attachment, a two-component type developer including such a magnetic coated carrier, and a developing method using the two-component type developer.

Another object of the present invention is to provide a magnetic coated carrier showing excellent flowability and capable of obviating image deterioration and liberation of metal oxide particles even in a continuous image formation on a large number of sheets, a two-component type developer including such a magnetic coated carrier, and a developing method using the two-component type developer.

A further object of the present invention is to provide a two-component type developer capable suppressing the occurrence of fog and adapted to a cleaner-less image forming process, and a developing method using the two-component type developer.

Another object of the present invention is to provide a two-component type developer adapted to a low-temperature fixation process and a cleaner-less process, having an improved durability in repetitive use and free from filming on a photosensitive member and a developing method using the two-component type developer.

Another object of the present invention is to provide a stable developing method adapted to a low-temperature fixation process and free from melt-sticking of the developer on a developer-carrying member for a long period.

According to the present invention, there is provided a magnetic coated carrier, comprising: magnetic coated carrier particles comprising magnetic carrier core particles each comprising a binder resin and metal oxide particles, and a coating layer surface-coating each carrier core particle, wherein the metal oxide particles have been subjected to a surface lipophilicity-imparting treatment, the magnetic carrier core particles have a resistivity of at least $1\times10^{10}$ ohm.cm, the magnetic coated carrier has a resistivity of at least $1\times10^{12}$ ohm.cm, and the magnetic coated carrier has a particle size distribution such that (i) it has a number-average particle size Dn of 5–100 μm, (ii) it satisfies a relationship of $Dn/\sigma \geqq 3.5$, wherein σ denotes a standard deviation of number-basis particle size distribution of the carrier, and (iii) it contains at most 25% by number of particles having particle sizes of at most Dn×⅔.

According to the present invention, there is also provided a two-component type developer for developing an electrostatic image, comprising: a toner and the above-mentioned magnetic coated carrier.

According to the present invention, there is further provided a developing method, comprising: carrying the above-mentioned two-component type developer on a developer-carrying member enclosing therein a magnetic field generating means, forming a magnetic brush of the two-component type developer on the developer-carrying member, causing the magnetic brush to contact an image-bearing member, and developing an electrostatic image on the image-bearing member while applying an alternating electric field to the developer-carrying member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
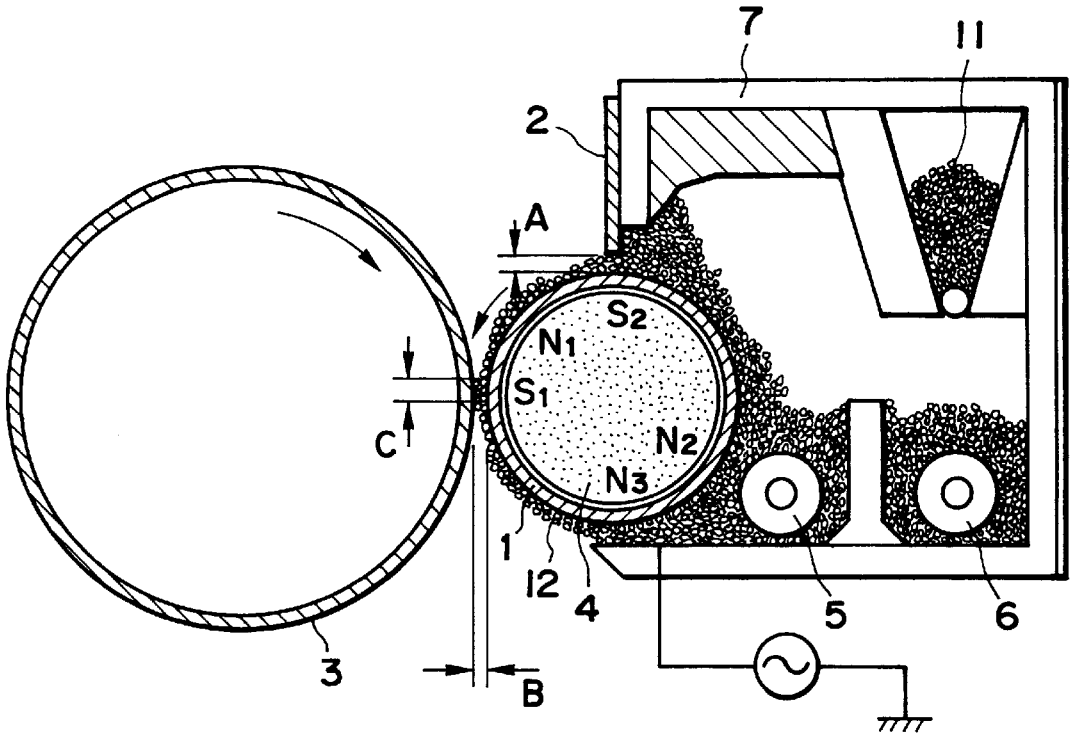
FIG. 1 is a schematic illustration of a developing section of an image forming apparatus suitable for practicing an embodiment of the developing method according to the invention.

As a result of our study, it has been found that, as the average particle size of a carrier is decreased, a magnetic coated carrier having a broad particle size distribution is liable to cause carrier attachment (i.e., attachment of carrier particles onto an electrostatic (latent) image-bearing member) selectively with respect to its small particle size fraction. It has been also found that the toner-carrying performance of a carrier is also affected by its particle size distribution and a carrier having a broad particle size distribution is liable to result in an unstable triboelectric charge of toner due to a lowering in flowability of the developer. It has been further found that the flowability of a developer is also affected by the surface shape of toner particles in case of a small toner particle size. Further, in case where a toner particle has a core/shell structure and the core contains a low-softening point substance, the toner is liable to be deteriorated and cause a lowering in flowability. Based on these findings, it has been found effective to control the magnetic coated carrier particle size distribution within a prescribed range, minimize the content of particles having particle sizes of Dn (number-average particle size)×⅔ and reduce the magnetic force exerted by the magnetic coated carrier for solving the above-mentioned problems.

In order to prevent the toner deterioration, it is effective to reduce the magnetic force exerted by the magnetic coated carrier, but it has been also found that this leads to an increase in carrier attachment in reverse proportion to the toner deterioration prevention effect. However, such an increased tendency of carrier attachment can be well suppressed by increasing the resistivity of magnetic coated carrier particles, particularly that of the core particles, and controlling the particle size distribution of the magnetic coated carrier. Further, a sharper particle size distribution of the magnetic coated carrier also favors the toner-charging performance or toner-chargeability (i.e., the ability of triboelectrically charging a toner of a carrier).

In the conventional carrier production process including pulverization and classification, it has been difficult to remove a fine powder fraction. On the other hand, a magnetic coated carrier having a shape factor SF-1 of 100–130 provides an improved flowability of the developer leading to a further improved toner-charging performance.

The magnetic coated carrier of the present invention has a number-average particle size (Dn) of 5–100 μm, preferably 10–70 μm. If Dn is smaller than 5 μm, it becomes difficult to well prevent the carrier attachment onto a non-image part due to a fine particle size fraction in the carrier particle size distribution. Dn larger than 100 μm can result in image irregularity due to its largeness while the brushing trace due to rigid magnetic brush can be obviated.

In the particle size distribution of the magnetic coated carrier according to the present invention, it is important that the carrier contains at most 25% by number (cumulative) of particles having particle sizes of at most Dn×⅔. The proportion is preferably at most 15% by number, further preferably at most 10% by number, in order to better prevent the carrier attachment even in case of a fluctuation in developing bias (voltage) as a developing condition of an image forming apparatus concerned.

It is also important to satisfy $Dn/\sigma \geqq 3.5$. $Dn/\sigma \geqq 4.0$ is preferred. Below 3.5, the flowability of the developer is lowered when combined with a small particle size toner having a weight-average particle size (D4) of 1–10 μm, thus resulting in an unstable toner-chargeability.

The binder resin constituting the carrier core particles used in the present invention may preferably be three-dimensionally crosslinked. This is because the control of carrier particle size distribution is closely related with the carrier production process. A magnetic material-dispersed resin carrier has been generally produced through a process wherein a binder resin and magnetic powder in a prescribed blend ratio are melt-kneaded under heating and the kneaded product is, after being cooled, pulverized and classified to provide a carrier. In this process, the particle size distribution can be narrowed to some extent through an improvement in the pulverization step as disclosed in JP-A 7-43951. However, because of the pulverization mechanism, the occurrence of some fine powder fraction is inevitable. Particularly, in case where a large quantity of magnetic powder is contained, over-pulverization is liable to occur. The resultant fine powder fraction cannot be completely removed by a classification operation, such as pneumatic classification or sieving. Further, in a carrier using a thermoplastic resin as the binder resin, the liberation of magnetic fine particles dispersed therein may be problematic during a continuous image formation on a large number of sheets. Now, it has been found possible to produce magnetic material-dispersed carrier core particles having a sharp particle size distribution and with little fine powder faction by using a polymerization process wherein polymerizate particles constituting carrier core particles are produced from a solution polymerization system including a monomer and a solvent (polymerization medium) as a uniform solution and by subjecting metal oxide particles to be dispersed in the carrier core particles to a surface lipophilicity-imparting treatment (sometimes referred to as "lipophilization" (or "lipophilized" for the treated particles)). This is presumably because the particulation of the polymerizable mixture is proceeded while the monomer is polymerized to be gelled simultaneously with the introduction of the metal oxide particles thereinto, thereby allowing the production of carrier core particles having a uniform particle size distribution and particularly with little fine powder fraction. Further, by three-dimensionally crosslinking the resin, the magnetic fine particles dispersed therein can be further firmly bound therewith.

In the case of using a small-particle size toner as represented by a weight-average particle size (D4) of 1–10 $\mu$m, it is preferred that the carrier particle size is also reduced corresponding to the toner. The above-mentioned process allows the production of carrier particles with little fine powder fraction regardless of a reduced average carrier particle size.

For constituting the binder resin of the carrier core particles through pulverization, it is possible to use a radically polymerizable monomer, examples of which may include: styrene; styrene derivatives, such as o-methylstyrene, m-methylstyrene; p-methoxystyrene, p-ethylstyrene, and p-tert-butylstyrene; acrylic acid, methacrylic acid; acrylate esters, such as methyl acrylate, ethyl acrylate, n-butyl acrylate, n-propyl acrylate, isobutyl acrylate, octyl acrylate, dodecyl acrylate, 2-ethylhexyl acrylate, stearyl acrylate, 2-chloroethyl acrylate, and phenyl acrylate; methacrylate esters, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminomethyl methacrylate, diethylaminoethyl methacrylate acrylate, and benzyl methacrylate; 2-hydroethyl acrylate, 2-hydroxyethyl methacrylate; acrylonitrile, methacrylonitrile, acrylamide; vinyl ethers, such as methyl vinyl ether, ethyl vinyl ether, propyl vinyl ether, n-butyl vinyl ether, isobutyl vinyl ether, β-chloroethyl vinyl ether, phenyl vinyl ether, p-methylphenyl vinyl ether, p-chlorophenyl vinyl ether, p-bromophenyl vinyl ether, p-nitrophenyl vinyl ether, and p-methoxyphenyl vinyl ether; and diene compounds, such as butadiene.

These monomers may be used singly or in mixture so as to provide a polymer composition exhibiting preferred properties.

It is preferred that the binder resin of the carrier core particles is three-dimensionally crosslinked. As a crosslinking agent, it is preferred to use a compound having at least two polymerizable double bonds in one molecule. Examples of such a crosslinking agent may include: aromatic divinyl compounds, such as divinylbenzene and divinylnaphthalene; ethylene glycol diacrylate, ethylene glycol dimethacrylate, tetraethylene glycol dimethacrylate, 1,3-butylene glycol dimethacrylate, 1,3-butylene glycol dimethacrylate, trimethylolpropane triacrylate, trimethylolpropane trimethacrylate, 1,4-butanediol diacrylate, neopentyl glycol diacrylate, 1,6-hexanediol diacrylate, pentaerythritol triacrylate, pentaerythritol tetraacrylate, pentaerythritol dimethacrylate, pentaerythritol tetramethacrylate, glycerol octyloxydimethacrylate, N,N-divinylaniline, divinyl sulfide, and divinyl sulfone. These can be used in mixture of two or more species. The crosslinking agent may be added to the polymerizable mixture in advance or added later at an appropriate stage during the polymerization.

The binder resin for the carrier core particles may also be produced from other monomers, examples of which may include: bisphenols and epichlorohydrin as starting materials for epoxy resins; phenols and aldehydes for phenolic resins; urea and aldehydes for urea resins, and melamine and aldehydes for melamine resins.

The most preferred binder resin may be phenolic resins as produced from starting materials, such as: phenol compounds, such as phenol, m-cresol, 3,5-xylene, p-alkylphenol, resorcin, and p-tert-butylphenol; and aldehyde compounds, such as formalin, para-formaldehyde, an furfural. The combination of phenol and formalin is particularly preferred.

For such a phenolic resin or a melamine resin, it is possible to use a basic catalyst as a curing catalyst. The basic catalyst may suitably be one ordinarily used for production of resol resins. Examples thereof may include: ammonia water, and amines, such as hexamethylenetetramine, diethyltriamine and polyethyleneimine.

The metal oxide for use in the carrier core particles of the carrier according to the present invention may comprise magnetite or ferrite as represented by the formula of $MO.Fe_2O_3$ (or $MFe_2O_4$), wherein M denotes a tri-valent, di-valent or mono-valent metal ion. Examples of M may include: Mg, Al, Si, Ca, Sc, Ti, V, Cr, Mn, Fe, Co, Ni, Cu, Zn, Sr, Y, Zr, Nb, Mo, Cd, Sn, Ba, Pb and Li. M may represent one or plural species of metals. Suitable examples of magnetic metal oxides may include: iron-based oxide materials, such as magnetite, Zn—Fe-based ferrite, Mn—Zn—Fe-based ferrite, Ni—Zn—Fe-based ferrite, Mn—Mg—Fe-based ferrite, Ca—Mn—Fe-based ferrite, Ca—Mg—Fe-based ferrite, Li—Fe-based ferrite, and Cu—Zn—Fe-based ferrite. It is also possible to use such a magnetic metal oxide in mixture with a non-magnetic metal oxide. Specific examples of non-magnetic metal oxides may include: $Al_2O_3$, $SiO_2$, CaO, $TiO_2$, $V_2O_5$, $CrO_2$, $MnO_2$, $\alpha$-$Fe_2O_3$, CoO, NiO, CuO, ZnO, SrO, $Y_2O_3$ and $ZrO_2$.

Further to say, it is possible to disperse a single species of metal oxide in the resin, but it is particularly preferred to disperse at least two species of metal oxides in mixture in the resin. In the latter case, it is preferred to use plural species of particles having similar specific gravities and/or shapes in order to provide an increased adhesion and a high carrier strength. A preferred type of combination of plural species of metal oxides may include a combination of a low-resistivity magnetic metal oxide and a high-resistivity magnetic or non-magnetic metal oxide. A combination of a low-resistivity magnetic metal oxide and a high-resistivity non-magnetic metal oxide is particularly preferred.

Examples of preferred combination may include: magnetite and hematite ($\alpha$-$Fe_2O_3$), magnetite and $\gamma$-$Fe_2O_3$, magnetite and $SiO_2$, magnetite and $Al_2O_3$, magnetite and $TiO_2$, magnetite and Ca—Mn—Fe-based ferrite, and magnetite and Ca—Mg—Fe-based ferrite. Among these, the combination of magnetite and hematite is particularly preferred.

In the case of dispersing the above-mentioned metal oxide in a resin to provide core particles, the metal oxide showing magnetism may preferably have a number-average particle size of 0.02–2 μm while it can vary depending on the number-average particle size of the carrier core particles. In the case of dispersing two or more species of metal oxides in combination, a metal oxide showing magnetism and having a generally lower resistivity may preferably have a number-average particle size ra of 0.02–2 μm, and another metal oxide preferably having a higher resistivity than the magnetic metal oxide (which may be non-magnetic) may preferably have a number-average particle size rb of 0.05–5 μm. In this instance, a ratio rb/ra may preferably exceed 1.0 and be at most 5.0. A ratio rb/ra of 1.2–5 is further preferred. If the ratio is 1.0 or below, it is difficult to form a state that the metal oxide particles having a higher resistivity are exposed to the core particle surface, so that it becomes difficult to sufficiently increase the core resistivity and obtain an effect of preventing the carrier attachment. On the other hand, if the ratio exceeds 5.0, it becomes difficult to disperse the metal oxide particles in the resin, thus being liable to result in a lower mechanical strength of the magnetic carrier and liberation of the metal oxide. The method of measuring the particle size of metal oxides referred to herein will be described hereinafter.

Regarding the metal oxides dispersed in the resin, the magnetic particles may preferably have a resistivity of at least $1\times10^3$ ohm.cm, more preferably at least $1\times10^5$ ohm.cm. Particularly, in the case of using two or more species of metal oxides in mixture, magnetic metal oxide particles may preferably have a resistivity of at least $1\times10^3$ ohm.cm, and preferably non-magnetic other metal oxide particles may preferably have a resistivity higher than that of the magnetic metal oxide particles. More preferably, the other metal oxide particles may have a resistivity of at least $10^8$ ohm.cm, further preferably at least $1\times10^{10}$ ohm.cm.

If the magnetic metal oxide particles have a resistivity below $1\times10^3$ ohm.cm, it is difficult to have a desired resistivity of carrier even if the amount of the metal oxide dispersed is reduced, thus being liable to cause charge injection leading to inferior image quality and invite the carrier attachment. In the case of dispersing two or more metal oxides, if the metal oxide having a larger particle size has a resistivity below $1\times10^8$ ohm.cm, it becomes difficult to sufficiently increase the carrier core resistivity, thus being difficult to accomplish the object of the present invention. The method of measuring resistivities of metal oxides referred to herein will be described hereinafter.

The metal oxide-dispersed resin carrier core used in the present invention may preferably contain 50–99 wt. % of the metal oxide. If the metal oxide content is below 50 wt. %, the charging ability of the resultant magnetic carrier becomes unstable and, particularly in a low temperature-low humidity environment, the magnetic carrier is charged and is liable to have a remanent charge, so that fine toner particles and an external additive thereto are liable to be attached to the surfaces of the magnetic carrier particles. In excess of 99 wt. %, the resultant carrier particles are caused to have an insufficient strength and are liable to cause difficulties of carrier particle breakage and liberation of metal oxide fine particles from the carrier particles during a continuous image formation.

As a further preferred embodiment of the present invention, in the metal oxide-dispersed resin core containing two or more species of metal oxides dispersed therein, the magnetic metal oxide may preferably occupy 30–95 wt. % of the total metal oxides. A content of below 30 wt. % may be preferred to provide a high-resistivity core, but results in a carrier exerting a small magnetic force, thus inviting the carrier attachment in some cases. Above 95 wt. %, it becomes difficult to increase the core resistivity.

It is further preferred that the metal oxide contained in the metal oxide-dispersed resin carrier core has been subjected to a lipophilicity-imparting treatment ("lipophilization") so as to provide magnetic carrier core particles having a sharp particle size distribution and prevent the liberation of metal oxide particles from the carrier. In the case of forming carrier core particles containing metal oxide particles by direct polymerization in a polymerization liquid system containing a uniform solution of a monomer and a solvent, insolubilized polymerizable particles are gradually formed in the system as the polymerization proceeds while taking therein the metal oxide particles. In this instance, the lipophilization is believed to exhibit functions of promoting uniform and high-density taking-in of the metal oxide particle. In the polymerizate particles and preventing the coalescence of the particles to provide a sharper distribution of the product carrier core particles.

The lipophilization may preferably be performed as a surface-treatment with a coupling agent, such as a silane coupling agent, a titanate coupling agent or an aluminum coupling agent, or a surfactant. It is particularly preferred to effect a surface-treatment with a coupling agent, such as a silane coupling agent or a titanate coupling agent.

The silane coupling agent may have a hydrophobic group, an amino group or an epoxy group.

Examples of the hydrophobic group may include alkyl group, alkenyl group, halogenated alkyl group, halogenated alkenyl group, phenyl group, halogenated phenyl group, or alkyl phenyl group. A preferred class of silane coupling agents having a hydrophobic group may be those represented by the following formula: $R_mSiY_n$, wherein R denotes an alkoxy group, Y denotes an alkyl or vinyl group, and m and n are integers of 1–3.

Preferred examples of the silane coupling agent having a hydrophobic group may include: vinyltrimethoxysilane, vinyltriethoxysilane, vinyltriacetoxysilane, methyltrimethoxysilane, methyltriethoxysilane, isobutyltriethoxysilane, dimethyldimethoxysilane, dimethyldiethoxysilane, trimethylmethoxysilane, n-propyltrimethoxysilane, phenyltrimethoxysilane, n-hexadecyltrimethoxysilane, n-octadecyltrimethoxysilane, and vinyltris(β-methoxy)-silane.

It is also possible to use a silane coupling agent having a hydrophobic group selected from the group consisting of vinyltrichlorosilane, hexamethyldisilazane, trimethylsilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, and chloromethyldimethylchlorosilane.

Examples of silane coupling agent having an amino group may include: γ-aminopropyltrimethoxysilane, γ-aminopropylmethoxydiethoxysilane, N-β-aminoethyl-γ-aminopropyltrimethoxysilane, γ-aminopropylmethyldiethoxysilane, N-β-aminoethyl-γ-aminopropylmethyldimethoxysilane, γ-2-aminoethylaminopropyltrimethoxysilane, and N-phenyl--aminopropyltrimethoxysilane.

Examples of silane coupling agent having an epoxy group may include: γ-glycidoxypropylmethyldiethoxysilane, γ-glycidoxypropyltriethoxysilane, and β-(3,4-epoxycyclohexyl)trimethoxysilane.

Examples of titanate coupling agent may include: isopropyltriisostearoyl titanate, isopropyltridodecylbenzenesulfonyl titanate, isopropyltris(dioctylpyrophosphate) titanate, isopropyltri(N-aminoethyl-aminoethyl) titanate, and isopropyl-4-aminobenzene-sulfonyl-di (dodecylbenzenesulfonyl) titanate.

The aluminum coupling agent may for example be acetoalkoxyaluminum diisopropylate.

The magnetic carrier core particles may be prepared by subjecting to polymerization a polymerization system formed by dissolving or dispersing the above-mentioned monomer and metal oxide particles in a solvent and adding thereto an initiator or catalyst and optionally a surfactant or dispersion stabilizer. In this instance, the solvent may comprise a substance wherein the monomer is soluble but the polymerizate thereof constituting the binder resin is insoluble to be precipitated as the polymerization proceeds. Specific examples of such a solvent may include: linear or branched aliphatic alcohols, such as methanol, ethanol, 1-propanol, 2-propanol, 1-butanol, 2-butanol, isobutyl alcohol, bert-butyl alcohol, 1-pentanol, 2-pentanol, 3-pentanol, 2-methyl-1-butanol, isopentyl alcohol, tert-pentyl alcohol, 1-hexanol, 2-methyl-1-pentanol, 4-methyl-2-pentanol, 2-ethylbutanol, 1-heptanol, 2-heptanol, 3-heptanol, 2-octanol, and 2-ethyl-1-hexanol; aliphatic hydrocarbons, such as pentane, 2-methylbutane, n-hexane, cyclohexane, 2-methylpentane, 2,2-dimethylbutane, 2,3-dimethylbutane, heptane, n-octane, isooctane, 2,2,3-trimethylpentane, decan, nonane, cyclopentane, methylcyclopentane, methylcyclohexane, ethylcyclohexane, p-menthane, and cyclohexyl: aromatic hydrocarbons; halogenated hydrocarbons; ether compounds; aliphatic acids; sulfur-containing compounds; and water. These solvents may be used singly or in mixture.

It is possible to use a dispersion stabilizer, examples of which may include: polystyrene, polymethyl methacrylate, phenol novolak resin, cresol novolak resin, styrene-acrylic copolymer; vinyl ether polymers, such as polymethyl vinyl ether, polyethyl vinyl ether, polybutyl vinyl ether, and polyisobutyl vinyl ether; polyvinyl alcohol, polyvinyl acetate, styrene-butadiene copolymer, ethylene-vinyl acetate copolymer, polyvinylpyrrolidone, polyhydroxystyrene, polyvinyl chloride, polyvinyl acetal, cellulose, cellulose acetate, nitrocellulose, alkylated celluloses, hydroxyalkylated celluloses such as hydroxymethylcellulose and hydroxypropylcellulose, saturated alkyl polyester resins, aromatic polyester resins, polyamide resins, polyacetals, and polycarbonate resins. These may be used singly or in combination of two or more species.

The polymerization of the above-mentioned monomer may be performed in the presence of a polymerization initiator, which may be a radical polymerization initiator.

Examples of the polymerization initiator may include: azo-type polymerization initiators, such as 2,2'-azobis-(2,4-dimethylvaleronitrile), 2,2'-azobisisobutylonitrile, 1,1'-azobis(cyclohexane-2-carbonitrile), 2,2'-azobis-4-methoxy-2,4-dimethylvaleronitrile, azobisisobutylonitrile; amidine compounds, such as 2,2'-azobis(2-aminodipropane)-dihydrochloride, 2,2'-azobis(N,N'-dimethyleneisobutylamidine), and 2,2'-azobis(N,N'-dimethyleneisobutylamidine; peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide; and persulfate-type initiators, such as potassium persulfate, and ammonium persulfate. These initiators may be used alone or in combination.

Carrier core particles comprising a setting-type phenolic resin may be produced by polymerizing a phenol and an aldehyde in the presence of a basic catalyst in an aqueous medium containing metal oxide particles dispersed therein.

Examples of the basic catalyst may include ammonia water, hexamethylenetetramine, and diethyltriamine.

In the polymerization, it is possible to use a chain transfer agent, examples of which may include: halogenated hydrocarbons, such as carbon tetrachloride, carbon tetrabromide, dibromoethyl acetate, tribromomethyl acetate, dibromoethylbenzene, dibromoethane, and dichloroethane; diazothioether, hydrocarbon homologues, such as benzene, ethylbenzene and isopropylbenzene; mercaptans, such as tert-dodecylmercaptan, and n-dodecylmercaptan; and disulfides, such as diisopropylxanthogene disulfides.

In a preferred process for producing carrier core particles, it is preferred that the monomer and the solvent form a uniform solution, and the metal oxide particles have been lipophilized. It is further preferred that the above ingredients are sufficiently dispersed in advance of the polymerization, followed by addition of a catalyst or polymerization initiator to initiate the polymerization so as to provide a sharp particle size distribution of magnetic carrier core particles. After the polymerization, the resultant polymerizate particles are washed with the solvent, dried, e.g., by vacuum drying and optionally subjected to classification to provide a narrower particle size distribution. The classification may be performed by using vibrating sieves or a multi-division classifier utilizing an inertia force so as to remove fine and coarse powder fractions.

The magnetic coated carrier according to the present invention may be obtained by coating the above-prepared magnetic carrier core particles with an appropriate coating material. The coating rate may preferably be 0.1–10 wt. %, more preferably 0.3–5 wt. %. In the magnetic metal oxide-dispersed resin carrier according to the present invention, the coating may preferably be performed so as to provide a metal oxide particle-exposure density at the carrier core particle surface of 0.1–10 particles/μm, more preferably 0.5–5 particles/μm so as to well prevent the carrier attachment and prevent the excessive charge-up of the toner.

If the coating rate is below 0.1 wt. %, the effect of coating the carrier core particles is low, thus resulting in a lower toner-chargeability (i.e., a lower ability of triboelectrically charging the toner) especially after a continuous image formation. On the other hand, if the coating rate exceeds 10 wt. %, the carrier flowability is liable to be lowered, thus resulting in inferior images during continuous image formation on a large number of sheets. The method of determining the metal oxide particle-exposure density at the carrier core particle surface will be described later.

The coating material may comprise a thermoplastic resin or a thermosetting resin. Examples of the thermoplastic resin may include: polystyrene resin, polymethyl methacrylate resin, styrene-acrylate copolymer, acrylic resin, styrene-butadiene copolymer, ethylene-vinyl acetate copolymer, vinyl chloride resin, vinyl acetate resin, polyvinylidene fluoride resin, fluorocarbon resin, perfluorocarbon resin, solvent-soluble perfluorocarbon resin, polyvinyl alcohol, polyvinyl acetal, polyvinylpyrrolidone, petroleum resin, cellulose, cellulose acetate, nitrocellulose, methylcellulose, hydroxymethylcellulose, hydroxyethylcellulose, hydroxypropylcellulose, cellulose derivative, novolak resin, low-molecular weight polyethylene, saturated alkyl polyester resin, polyethylene terephthalate, polybutylene terephthalate, aromatic polyester resins such as polyarylate, polyamide resin, polyacetal resin, polycarbonate resin, polyethersulfone resin, polysulfone resin, polyphenylene sulfide resin, and polyether ketone resin.

Examples of the thermosetting resin may include: phenolic resin, modified phenolic resin, maleic resin, alkyd resin, epoxy resin, acrylic resin, unsaturated polyester formed by polycondensation of maleic anhydride-terephthalic acid-polyhydric alcohol, urea resin, melamine resin, urea-melamine resin, xylene resin, toluene resin, guanamine resin, melamine-guanamine resin, acetoguanamine resin, glyptal resin, furan resin, silicone resin, acryl-modified silicone resin, epoxy-modified silicone resin, silicone alkyd resin, polyimide, polyamideimide resin, polyetherimide resin, and polyurethane resin. These resins may be used singly or in mixture. Further, a thermoplastic resin may be subjected to curing by mixing a curing agent.

The magnetic coated carrier may preferably be produced by spraying a coating resin solution onto carrier core particles in a floating or fluidized state to form a coating film on the core particle surfaces, or by spray drying. This coating method may suitably be used for coating the magnetic carrier-dispersed resin core particles with a thermoplastic resin.

Other coating methods may include gradual evaporation of the solvent in a coating resin solution in the presence of a metal oxide under application of a shearing force.

The magnetic coated carrier according to the present invention may preferably designed to be substantially spherical in shape as represented by a shape factor SF-1 in the range of 100–130. If SF-1 exceeds 130, the resultant developer is caused to have a poor fluidity and provides a magnetic brush of an inferior shape, so that it becomes difficult to obtain high-quality toner images. The shape factor SF-1 of a carrier may be measured, e.g., by sampling at least 300 carrier particles at random through a field-emission scanning electron microscope (e.g., "S-800", available from Hitachi K.K.) at a magnification of 300 and measuring an average of the sphericity defined by the following equation by using an image analyzer (e.g., "Luzex 3", available from Nireco K.K.):

$$SF\text{-}1=[(MX\ LNG)^2/AREA]\times\pi/4\times100,$$

wherein MX LNG denotes the maximum diameter of a carrier particle, and AREA denotes the projection area of the carrier particle.

As for the magnetic properties of the magnetic carrier used in the present invention, it is preferred to use a magnetic carrier exerting a low magnetic force as represented by a magnetization of 40–250 emu/cm$^3$, more preferably 50–230 emu/cm$^3$, respectively at 1 kilo-oersted. The magnetization of the magnetic carrier may be appropriately selected depending on the particle size of the carrier. While being also affected by the particle size, a magnetic carrier having a magnetization in excess of 250 emu/cm$^3$ is liable to result in a magnetic brush formed on a developer sleeve at developing pole having a low density and comprising long and rigid ears, thus being liable to result in rubbing traces in the resultant toner images, and deterioration of the developer during a continuous image formation. Particularly, when combined with a toner having a core/shell structure including the core containing a low-softening point substance, image defects, such as roughening of halftone images and irregularity of solid images, are liable to occur particularly due to deterioration of the toner. Below 40 emu/cm$^3$, the magnetic carrier is caused to exert only an insufficient magnetic force to result in a lower toner-conveying performance, and toner attachment, even if the fine powder fraction of the carrier is removed.

The magnetic properties referred to herein are values measured by using an oscillating magnetic field-type magnetic property auto-recording apparatus ("BHV-30", available from Riken Denshi K.K.). Specific conditions for the measurement will be described hereinafter.

The toner used in the present invention may have a weight-average particle size (D4) of 1–10 $\mu$m, preferably 3–8 $\mu$m. Further, in order to effect good triboelectrification free from occurrence of reverse charge fraction and good reproducibility of latent image dots, it is preferred to satisfy such a particle size distribution that the toner particles contain at most 20% by number in accumulation of particles having particle sizes in the range of at most a half of the number-average particle size (D1) thereof and contain at most 10% by volume in accumulation of particles having particle sizes in the range of at least two times the weight-average particle size (D4) thereof. In order to provide a toner with further improved triboelectric chargeability and dot reproducibility, it is preferred that the toner particles contain at most 15% by number, further preferably at most 10% by number, of particles having sizes of at most ½×D1, and at most 5% by volume, further preferably at most 2% by volume of particles having sizes of at least 2×D4.

If the toner has a weight-average particle size (D4) exceeding 10 $\mu$m, the toner particles for developing electrostatic latent images become so large that development faithful to the latent images cannot be performed even if the magnetic force of the magnetic carrier is lowered, and extensive toner scattering is caused when subjected to electrostatic transfer. If D4 is below 1 $\mu$m, the toner causes difficulties in powder handling characteristic.

If the cumulative amount of particles having sizes of at most a half of the number-average particle size (D1) exceeds 20% by number, the triboelectrification of such fine toner particles cannot be satisfactorily effected to result in difficulties, such as a broad triboelectric charge distribution of the toner, charging failure (occurrence of reverse charge fraction) and a particle size change during continuous image formation due to localization of toner particle sizes. If the cumulative amount of particles having sizes of at least two times the weight-average particle size (D4) exceeds 10% by volume, the triboelectrification with the metal oxide becomes difficult, and faithful reproduction of latent images becomes difficult. The toner particle size distribution may be measured, e.g., by using a laser scanning-type particle size distribution meter (e.g., "CIS-100", available from GALIA Co.).

The particle size and particle size distribution of the toner used in the present invention are closely associated with the particle size and its distribution of the magnetic carrier. When the magnetic carrier has a number-average particle size of 15–50 $\mu$m, it is preferred that the toner has a weight-average particle size of 3–8 $\mu$m and both the toner and the carrier have narrow particle size distributions so as to provide a good chargeability and high-quality images.

In case where the developer according to the present invention is used in a simultaneous development and cleaning system or a cleaner-less image forming system, it is preferred that the toner has a shape factor SF-1 of 100–140, and has been produced through a directed polymerization process while leaving a residual monomer content (Mres) of at most 1000 ppm.

An example of such a cleaner-less system is explained. In case of using a negatively chargeable photosensitive member together with a negatively chargeable toner, a developed toner image is transferred onto a transfer(-receiving) material by means of a positively charged transfer member. In this case, depending on the relationship between the attributes (thickness, resistivity and dielectric constant) of the transfer material and the image area formed on the transfer material, the charging polarity of the transfer residual toner can vary from positive to negative. However, even if the transfer residual toner is charged to a positive polarity, the residual toner can be uniformly charged to a negative polarity during the charging of the photosensitive member by means of a negatively charged charging member. Accordingly, in case of the reversal development mode, the residual toner at a light potential part to be developed is allowed to remain thereat but the residual toner at a dark potential part is attracted to the developer-carrying member under the action of a developing field, thus being removed.

As a result of our extensive study on various toners and carriers, the performances, such as continuous image forming characteristic, of a developer in the simultaneous development and clearing system or cleaner-less image forming system is closely associated with the magnetic force of the carrier and the residual monomer content in the toner. The effect of the carrier has been described above. As for the toner, the residual monomer content has influences as follows. For example, in the case of a toner principally comprising a binder resin, a colorant and a charge control agent. The residual monomer is contained in the toner particles and affects the thermal behavior around the glass transition point of the toner. The monomer is a low-molecular weight component so that it functions to plasticize the toner particles. On the other hand, the toner subjected to discharging or corona shower receives an actinic action thereof on its binder layer. For example, the monomer chains in the resin may be severed to result weight components or, reversely, the resin decomposition product may promote the polymerization. On the other hand, the residual monomer in the toner may be activated by the actinic function of the charging member for the photosensitive member.

As described above, the toner contains reactive low-molecular weight components which compete with each other. The charge control agent contained in the toner particles is also a compound relatively rich in electron donating and receiving actions. For these factors in combination which have not been fully clarified as yet, the presence of residual monomer promotes gradual change in surface properties of the toner particles, such as toner flowability and chargeability.

In view of these factors, the toner may preferably have a low residual monomer content of at most 1000 ppm, more preferably at most 500 ppm, further preferably at most 300 ppm, so as to provide good continuous image forming characteristic and good quality images. The method of determining the residual monomer content in a toner will be described later.

The toner may preferably have a shape factor SF-1 of 100–140, more preferably 100–130. This is particularly effective in a simultaneous developing and cleaning system or a cleaner-less image forming system. The shape factor SF-1 of a toner may be measured, e.g., by sampling at least 300 enlarged toner images (at a magnification of 300) at random through a field-emission scanning electron microscope ("S-800", available from Hitachi Seisakusho K.K.) and introducing the image data to an image analyzer ("Luzex 3", available from Nireco K.K.) for calculation according to the following scheme:

$$SF\text{-}1=[(MX\ LNG)^2/AREA]\times\pi/4\times100,$$

wherein MX LNG denotes the maximum diameter of a toner particle, and AREA denotes the projection area of the toner particle.

The shape factor SF-1 represents a sphericity, and SF-1 exceeding 140 means an indefinite shape different from a sphere. If-the toner has a SF-1 exceeding 140, the toner is liable to provide a lower toner transfer efficiency from a photosensitive member to a transfer material and leave much residual toner on the photosensitive member. In this regard, toner particles prepared directly through a polymerization process may have a shape factor SF-1 close to 100 and have a smooth surface. Because of the surface smoothness, an electric field concentration occurring at the surface unevennesses of the toner particles can be alleviated to provide an increased transfer efficiency or transfer rate.

The toner particles used in the present invention may preferably have a core/shell structure (or a pseudo-capsule structure). Such toner particles having a core/shell structure may be provided with a good anti-blocking characteristic without impairing the low-temperature fixability. Compared with a bulk polymerization toner having no core structure, a toner having a core/shell structure prepared by forming a shell enclosing a core of a low-softening point substance through polymerization allows easier removal of the residual monomer from the toner particles in a post-treatment step after the polymerization step.

It is preferred that the core principally comprises a low-softening point substance. The low-softening point substance may preferably comprise a compound showing a main peak at a temperature within a range of 40–90° C. on a heat-absorption curve as measured according to ASTM D3418-8. If the heat-absorption main peak temperature is below 40° C., the low-softening point substance is liable to exhibit a low self-cohesion leading to a weak anti-high temperature offset characteristic. On the other hand, if the heat-absorption peak temperature is above 90° C., the resultant toner is liable to provide a high fixation temperature. Further, in the case of toner particle preparation through the direct polymerization process including particle formation and polymerization within an aqueous medium, if the heat-absorption main peak temperature is high, the low-softening point substance is liable to precipitate during particle formation of a monomer composition containing the substance within an aqueous medium.

The heat-absorption peak temperature measurement may be performed by using a scanning calorimeter ("DSC-7", available from Perkin-Elmer Corp.). The temperature correction for the detector of the apparatus may be made based on the melting points of indium and zinc, and the heat quantity correction may be made based on the melting heat of indium. A sample is placed on an aluminum-made pan, and a blank pan is also set as a control, for measurement at a temperature-raising rate of 10° C./min. The measurement may be performed in a temperature range of 30–160° C.

Examples of the low-softening point substance may include: paraffin wax, polyolefin wax, Fischer-Tropsche wax, amide wax, higher fatty acid, ester wax, and derivatives and graft/or block copolymerization products of these waxes.

The low-softening point substance may preferably be added in a proportion of 5–30 wt. % of the toner particles.

The toner particles may suitably be blended with an external additive. If the toner particles are coated with such an external additive, the external additive is caused to be present between the toner particles and between the toner and carrier, thereby providing an improved flowability and an improved life of the developer.

The external additive may for example comprise powder of materials as follows: metal oxides, such as aluminum oxide, titanium oxide, strontium titanate, cerium oxide, magnesium oxide, chromium oxide, tin oxide, and zinc oxide; nitrides, such as silicon nitride carbides, such as silicon carbide; metal salts, such as calcium sulfate, barium sulfate, and calcium sulfate; aliphatic acid metal salts such as zinc stearate, and calcium stearate; carbon black, silica, polytetrafluoroethylene, polyvinylidene fluoride, polymethyl methacrylate, polystyrene, and silicone resin. These powders may preferably have a number-average particle size (D1) of at most 0.2 $\mu$m. If the average particle size exceeds 0.2 $\mu$m, the toner is caused to have a lower flowability, thus resulting in lower image qualities due to inferior developing and transfer characteristic.

Such an external additive may be added in an amount of 0.01–10 wt. parts, preferably 0.05–5 wt. parts, per 100 wt. parts of the toner particles. Such external additives may be added singly or in combination of two or more species. It is preferred that such external additives have been hydrophobized (i.e., subjected to hydrophobicity-imparting treatment).

The external additive may preferably have a specific surface area of at least 30 $m^2/g$, particularly 50–400 $m^2/g$ as measured by the BET method according to nitrogen adsorption.

The toner particles and the external additive may be mixed with each other by means of a blender, such as a Henschel mixer. The resultant toner may be blended with carrier particles to form a two-component type developer. While depending on a particular developing process used, the two-component type developer may preferably contain 1–20 wt. %, more preferably 1–10 wt. %, of the toner. The toner in the two-component type developer may preferably have a triboelectric charge of 5–100 $\mu$C/g, more preferably 5–60 $\mu$C/g. The method for measuring the toner triboelectric charge will be described later.

The toner particles may for example be produced through a process when a binder resin, a colorant and other internal additives are melt-kneaded, and the melt-kneaded product is the cooled, pulverized and classified. Examples of the toner binder resin may include: polystyrene; polymers of styrene derivatives, such as poly-p-chlorostyrene, and polyvinyltoluene; styrene copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-methyl $\alpha$-chloromethacrylate copolymer, styrene-acrylonitrile copolymer, styrene-vinyl methyl ketone copolymer, styrene-butadiene copolymer, styrene-isoprene copolymer, and styrene-acrylonitrileindene copolymer; polyvinyl chloride, phenolic resin, modified phenolic resin, maleic acid resin, acrylic resin, methacrylic resin, acrylic resin, methacrylic resin, polyvinyl acetate, silicone resin, polyester resins formed from monomers selected from aliphatic polyhydric alcohols, aliphatic dicarboxylic acids, aromatic dicarboxylic acids, and aromatic diols and diphenols; polyurethane resin, polyamide resin, polyvinyl butyral, terpene resin, coumarone-indene resin, and petroleum resin. Styrene resins and polyester resins are particularly preferred.

As another class of preferred processes, the toner particles may for example be produced through a suspension polymerization process for directly producing toner particles, a dispersion polymerization process for directly producing toner particles in an aqueous organic solvent medium in which a monomer is soluble but the resultant polymer is insoluble, or an emulsion polymerization process, as represented by a soap-free polymerization process, for directly producing toner particles by polymerization in the presence of a water-soluble polar polymerization initiator.

The suspension polymerization under normal pressure or an elevated pressure may particularly preferably be used in the present invention because an SF-1 of the resultant toner particles can readily be controlled in a range of 100–140 and fine toner particles having a sharp particle size distribution and a weight-average particle size of 4–8 $\mu$m can be obtained relatively easily.

An enclosed structure of the low-softening point substance in the toner particles may be obtained through a process wherein the low-softening point substance is selected to have a polarity in an aqueous medium which polarity is lower than that of a principal monomer component and a small amount of a resin or monomer having a larger polarity is added thereto, to provide toner particles having a core-shell structure. The toner particle size and its distribution may be controlled by changing the species and amount of a hardly water-soluble inorganic salt or a dispersant functioning as a protective colloid; by controlling mechanical apparatus conditions, such as a rotor peripheral speed, a number of pass, and stirring conditions inclusive of the shape of a stirring blade; and/or by controlling the shape of a vessel and a solid content in the aqueous medium.

The outer shell resin of toner particles, may comprise styrene-(meth)acrylate copolymer, or styrene-butadiene copolymer. In the case of directly producing the toner particles through the polymerization process, monomers of these resins may be used.

Specific examples of such monomers may include: styrene and its derivatives such as styrene, o-, m- or p-methylstyrene, and m- or p-ethylstyrene; (meth)acrylic acid esters such as methyl (meth)acrylate, ethyl (meth) acrylate, propyl (meth)acrylate, butyl (meth)acrylate, octyl (meth)acrylate, dodecyl (meth)acrylate, 2-ethyhexyl (meth) acrylate, stearyl (meth)acrylate, behenyl (meth)acrylate, dimethylaminoethyl (meth)acrylate, and diethylaminoethyl (meth)acrylate; butadiene; isoprene; cyclohexane; (meth) acrylonitrile, and acrylamide.

These monomers may be used singly or in mixture of two or more species so as to provide a theoretical glass transition point (Tg), described in "POLYMER HANDBOOK", second addition, III-pp. 139–192 (available from John Wiley & Sons Co.), of 40–75° C. If the theoretical glass transition point is below 40° C., the resultant toner particles are liable to have lower storage stability and durability. On the other hand, if the theoretical glass transition point is in excess of 75° C., the fixation temperature of the toner particles is increased, whereby respective color toner particles are liable to have an insufficient color-mixing characteristic particularly in the case of the full-color image formation.

In the present invention, the molecular-weight distribution of THF-soluble content of the outer shell resin may be measured by gel permeation chromatography (GPC) as follows. In the case of toner particles having a core/shell structure, the toner particles are subjected to extraction with toluene for 20 hours by means of a Soxhlet extractor in advance, followed by distilling-off of the solvent (toluene) to obtain an extract. An organic solvent (e.g., chloroform) in which a low-softening point substance is dissolved and an outer resin is not dissolved is added to the extract and sufficiently washed therewith to obtain a residue product. The residue product is dissolved in tetrahydrofuran (THF) and subjected to filtration with a solvent-resistant membrane filter having a pore size of 0.3 μm to obtain a sample solution (THF solution). The sample solution is injected in a GPC apparatus ("GPC-150C", available from Waters Co.) using columns of A-801, 802, 803, 804, 805, 806 and 807 (manufactured by Showa Denko K.K.) in combination. The identification of sample molecular weight and its molecular weight distribution is performed based on a calibration curve obtained by using monodisperse polystyrene standard samples.

In the present invention, the THF-soluble content of the outer shell resin may preferably have a number-average molecular weight (Mn) of 5,000–1,000,000 and a ratio of weight-average molecular weight (Mw) to Mn (Mw/Mn) of 2–100.

In order to enclose the low-softening point compound in the outer resin (layer), it is particularly preferred to add a polar resin. Preferred examples of such a polar resin may include styrene-(meth)acrylic acid copolymer, styrene-maleic acid copolymer, saturated polyester resin and epoxy resin. The polar resin may particularly preferably have no unsaturated group capable of reacting with the outer resin or a vinyl monomer constituting the outer resin. This is because if the polar resin has an unsaturated group, the unsaturated group can cause crosslinking reaction with the vinyl monomer, thus resulting in an outer resin having a very high molecular weight, which is disadvantageous because of a poor color-mixing characteristic.

The toner particles having an outer shell structure can further be surface-coated by polymerization to have an outermost shell resin layer.

The outermost shell resin layer may preferably be designed to have a glass transition temperature which is higher than that of the outer shell resin layer therebelow and be crosslinked within an extent of not adversely affecting the fixability, in order to provide a further improved anti-blocking characteristic.

The method for providing such an outer shell resin layer is not particularly restricted but examples thereof may include the following:

(1) In the final stage of or after completion of the above-mentioned polymerization, a monomer composition containing optionally therein a color resin, a charge control agent or a crosslinking agent dissolved or dispersed therein is added to the polymerization system to have the polymerizate particles adsorb the monomer composition, and the system is subjected to polymerization in the presence of a polymerization initiator.

(2) Emulsion polymerizate particles or soap-free polymerizate particles formed from a monomer composition containing optionally a polar resin, a charge control agent or a crosslinking agent, are added to the polymerization system to be agglomerated onto the already present polymerizate particles, optionally followed by heating to be securely attached.

(3) Emulsion polymerizate particles or soap-free polymerizate particles formed from a monomer composition containing optionally a polar resin, a charge control agent or a crosslinking agent, are mechanically attached securely to the previously formed polymerizate or toner particles in a dry system.

The colorant used in the present invention may include a black colorant, yellow colorant, a magenta colorant and a cyan colorant.

Examples of non-magnetic black colorant may include: carbon black, and a colorant showing black by color-mixing of yellow/magenta/cyan colorants as shown below.

Examples of the yellow colorant may include: condensed azo compounds, isoindolinone compounds, anthraquinone compounds, azo metal complexes, methin compounds and arylamide compounds. Specific preferred examples thereof may include C.I. Pigment Yellow 12, 13, 14, 15, 17, 62, 74, 83, 93, 94, 95, 109, 110, 111, 128, 129, 147, 168 and 180.

Examples of the magenta colorant may include: condensed azo compounds, diketopyrrolpyrrole compounds, anthraquinone compounds, quinacridone compounds, basis dye lake compounds, naphthol compounds, benzimidazole compounds, thioindigo compounds an perylene compounds. Specific preferred examples thereof may include: C.I. Pigment Red 2, 3, 5, 6, 7, 23, 48:2, 48:3, 48:4, 57:1, 81:1, 144, 146, 166, 169, 177, 184, 185, 202, 206, 220, 221 and 254.

Examples of the cyan colorant may include: copper phthalocyanine compounds and their derivatives, anthraquinone compounds and basis dye lake compounds. Specific preferred examples thereof may include: C.I. Pigment Blue 1, 7, 15, 15:1, 15:2, 15:3, 15:4, 60, 62, and 66.

These colorants may be used singly, in mixture of two or more species or in a state of solid solution. The above colorants may be appropriately selected in view of hue, color saturation, color value, weather resistance, transparency of the resultant OHP film, and a dispersibility in toner particles. The above colorants may preferably be used in a proportion of 1–20 wt. parts per 100 wt. parts of the binder resin.

The charge control agent may be used in the present invention including known charge control agents. The charge control agent may preferably be one which is colorless and has a higher charging speed and a property capable of stably retaining a prescribed charge amount. In the case of using the direct polymerization for producing the toner particles of the present invention, the charge control agent may particularly preferably be one free from polymerization-inhibiting properties and not containing a component soluble in an aqueous medium.

The charge control agent may be those of negative-type or positive-type. Specific examples of the negative charge control agent may include: metal compounds organic acids, such as salicylic acid, dialkylsalicylic acid, naphtoic acid, dicarboxylic acid and derivatives of these acids; polymeric compounds having a side chain comprising sulfonic acid or carboxylic acid; borate compound; urea compounds; silicon compound; and calixarene. Specific examples of the positive charge control agent may include: quaternary ammonium salts; polymeric compounds having a side chain comprising quaternary ammonium salts; guanidine compounds; and imidazole compounds.

The charge control agent may preferably be used in a proportion of 0.5–10 wt. parts per 100 wt. parts of the binder resin. However, the charge control agent is not an essential component for the toner particles used in the present invention.

Examples of the polymerization initiator usable in the direct polymerization may include: azo-type polymerization initiators, such as 2,2'-azobis-(2,4-dimethylvaleronitrile), 2,2'-azobisisobutylonitrile, 1,1'-azobis(cyclohexane-2-carbonitrile), 2,2'-azobis-4-methoxy-2,4-dimethylvaleronitrile, azobisisobutylonitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide.

The addition amount of the polymerization initiator varies depending on a polymerization degree to be attained. The polymerization initiator may generally be used in the range of about 0.5–20 wt. % based on the weight of the polymerizable monomer. The polymerization initiators somewhat vary depending on the polymerization process used and may be used singly or in mixture while making reference to 10-hour half-life period temperature. In order to control the molecular weight of the resultant binder resin, it is also possible to add a crosslinking agent, a chain transfer agent, a polymerization inhibitor, etc.

In production of toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, polyacrylic acid and its salt and starch. These dispersion stabilizers may preferably be used in the aqueous dispersion medium in an amount of 0.2–10 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization. In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

The toner particles according to the present invention may also be produced by direct polymerization in the following manner. Into a polymerizable monomer, a low-softening point substance (release agent), a colorant, a charge control agent, a polymerization initiator and another optional additive are added and uniformly dissolved or dispersed by a homogenizer or an ultrasonic dispersing device, to form a polymerizable monomer composition, which is then dispersed and formed into particles in a dispersion medium containing a dispersion stabilizer by means of a stirrer, homomixer or homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50–90° C. The temperature can be raised at a latter stage of the polymerization. It is also possible to subject a part of the aqueous system to distillation in a latter stage of or after the polymerization in order to remove the yet-polymerized part of the polymerizable monomer and a by-product which can cause and odor in the toner fixation step. After the reaction, the produced toner particles are washed, filtered out, and dried. In the suspension polymerization, it is generally preferred to use 300–3000 wt. parts of water as the dispersion medium per 100 wt. parts of the monomer composition.

The toner particles can be further subjected to classification for controlling the particle size distribution. For example, it is preferred to use a multi-division classifier utilizing the Coanda effect according to a Coanda block so as to effectively produce toner particles having a desired particle size distribution.

The developing method according to the present invention may for example be performed by using a developing device as shown in FIG. 1. It is preferred to effect a development in a state where a magnetic brush formed of a developer contacts a latent image-bearing member, e.g., a photosensitive drum 3 under application of an alternating electric field. A developer-carrying member (developing sleeve) 1 may preferably be disposed to provide a gap B of 100–1000 $\mu$m from the photosensitive drum 3 in order to prevent the carrier attachment and improve the dot reproducibility. If the gap is narrower than 100 $\mu$m, the supply of the developer is liable to be insufficient to result in a low image density. In excess of 1000 $\mu$m, the lines of magnetic force exerted by a developing pole S1 is spread to provide a low density of magnetic brush, thus being liable to result in an inferior dot reproducibility and a weak carrier constraint force leading to carrier attachment.

The alternating electric field may preferably have a peak-to-peak voltage of 500–5000 volts and a frequency of 500–10000 Hz, preferably 500–3000 Hz, which may be selected appropriately depending on the process. The waveform therefor may be appropriately selected, such as triangular wave, rectangular wave, sinusoidal wave or waveforms obtained by modifying the duty ratio. Particularly, as the toner particle size is reduced, it is preferred to decrease the duty of a voltage component ($V_{forward}$) for producing toner transfer to the image-bearing member. If the application voltage is below 500 volts it may be difficult to obtain a sufficient image density and fog toner on a non-image region cannot be satisfactorily recovered in some cases. Above 5000 volts, the latent image can be disturbed by the magnetic brush to cause lower image qualities in some cases.

By using the two-component type developer according to the present invention, it becomes possible to use a lower fog-removing voltage (Vback) and a lower primary charge voltage on the photosensitive member, thereby increasing the life of the photosensitive member. Vback may preferably be at most 200 volts, more preferably at most 180 volts.

It is preferred to use a contrast potential of 200–500 volts so as to provide a sufficient image density. The frequency can affect the process, and a frequency below 500 Hz may result in charge injection to the carrier, which leads to lower image qualities due to carrier attachment and latent image disturbance, in some cases. Above 10000 Hz, it is difficult for the toner to follow the electric field, thus being liable to cause lower image qualities.

In the developing method according to the present invention, it is preferred to set a contact width (developing nip) C of the magnetic brush on the developing sleeve 1 with the photosensitive drum 3 at 3–8 mm in order to effect a development providing a sufficient image density and excellent dot reproducibility without causing carrier attachment. If the developing nip C is between 3–8 mm, it becomes possible to satisfy a sufficient image density and a good dot reproducibility. If broader than 8 mm, the developer is apt to be packed to stop the movement of the apparatus, and it may become difficult to sufficiently prevent the carrier attachment. The developing nip C may be appropriately adjusted by changing a distance A between a developer regulating member 2 and the developing sleeve 1 and/or changing the gap B between the developing sleeve 1 and the photosensitive drum 3.

The developing method according to the present invention may particularly suitably be adopted in a full-color image forming process wherein a halftone producibility is thought much of, while using the developer according to the present invention for developing digital latent images, whereby the dot latent images can be reproduced faithfully without adverse effect of the magnetic brush and without disordering electrostatic images.

By using the developer of the present invention, it is possible to realize not only high image qualities at the initial stage but also prevention of image quality deterioration during a continuous image formation on a large number of sheets because of a suppressed shearing force applied to the developer in the developing device.

Figure 3:
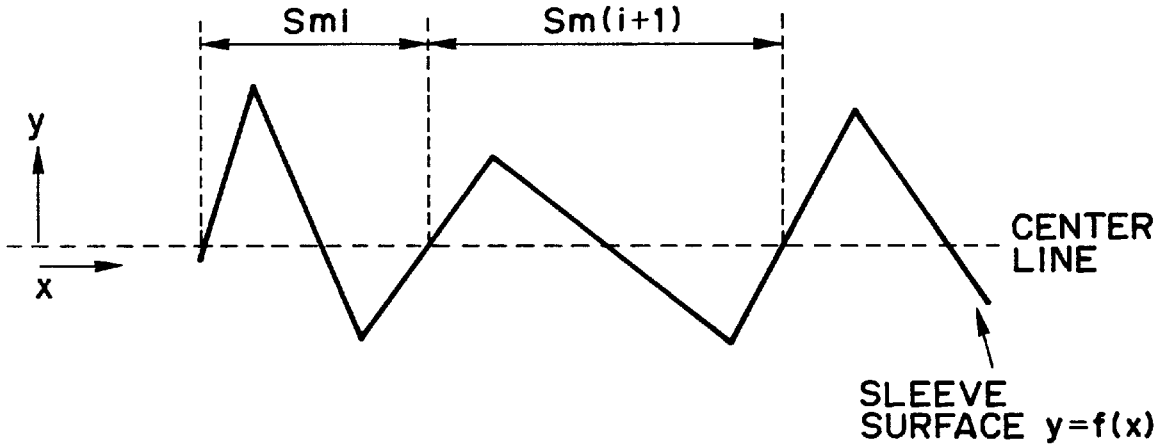
FIG. 3 is a schematic illustration of a surface unevenness state of a developer-carrying member.

The developer-carrying member used in the present invention may preferably satisfy the following surface state conditions, as illustrated in FIG. 3: 0.2 $\mu$m≦center line-average roughness (Ra)≦5.0 $\mu$m, 10 $\mu$m≦average unevenness spacing (Sm)≦80 $\mu$m and 0.05≦Ra/Sm≦0.5.

The parameters Ra and Sm refer to a center line-average roughness and an average unevenness spacing defined by JIS B0601 (and ISO 468) and obtained by the following formula:

$$Ra = (1/l)\int_0^l |f(x)|dx$$

$$Sm = (1/n)\sum_{i=1}^{n} Smi$$

If Ra is below 0.2 $\mu$m, the developer-carrying member shows an insufficient developer-conveying ability so that an image density irregularity is liable to be caused particularly in a continuous image formation. If Ra exceeds 5 $\mu$m, the developer-carrying member is excellent in toner-conveying ability but exerts too large a constraint force at a developer conveying regulation zone as by a regulating blade to cause deterioration by rubbing of an external additive to the toner particle surfaces, thus being liable to cause a lowering in image quality during a successive image formation.

If Sm exceeds 80 $\mu$m, the retention of a developer on the developer-carrying member becomes difficult to result in a lower image density. The mechanism thereof has not been fully clarified as yet but, in view of a phenomenon that a slippage of developer on the developer-carrying member is caused at the conveyance regulating zone of the developer-carrying member, it is assumed that the developer is densely packed to form a cake in case of too large an unevenness spacing and a force acting on the cake exceeds a retention force acting between the toner-developer-carrying member, thus resulting in a lower image density. If Sm is below 10 $\mu$m, many of unevennesses on the developer-carrying member become smaller than the average particle size of the developer, so that a particle size selection of developer entering the concavities occurs, thus being liable to cause melt-sticking of the developer fine powder fraction. Further, the production of the developer-carrying member is not easy.

In further view of the above-described points, an unevenness slope (=f(Ra/Sm)) obtained from a convexity height and an unevenness spacing on the developer-carrying member may preferably satisfy a relationship of 0.5≧Ra/Sm≧0.05, more preferably 0.3≧Ra≧0.07.

If Ra/Sm is below 0.05, the developer-carrying member shows too small a toner-retention force so that the retention of toner on the developer-carrying member becomes difficult and the conveyance to the developer regulation zone is not controlled, whereby an image density irregularity is liable to be caused. If Ra/Sm exceeds 0.5, the toner entering the concavities is not mixed circulatively with the other toner, so that the toner melt-sticking is liable to occur.

The values of Ra and Sm described herein are based on those measured according to JIS-B0601 by using a contact-type surface roughness tester ("SE-3300", mfd. by Kosaka Kenkyusho K.K.) by using a measurement length l of 2.5 mm and effecting measurement at arbitrarily selected several points on the surface of a developer-carrying member.

A developer-carrying member (sleeve) may be provided with a prescribed surface roughness, e.g., by sand blasting with abrasive particles comprising irregularly shaped or regularly shaped particles, rubbing of the sleeve with sand paper in directions in parallel with the axis thereof (i.e., directions perpendicular to the developer-conveying direction) for providing unevenness preferentially formed in the circumferential direction, chemical treatment, and coating with a resin followed by formation of resinous projections.

The developer-carrying member used in the present invention may be composed of a known material, examples of which may include: metals, such as aluminum, stainless steel, and nickel; a metal body coated with carbon, a resin or an elastomer; and elastomer, such as natural rubber, silicone rubber, urethane rubber, neoprene rubber, butadiene rubber and chloroprene rubber in the form of an unfoamed, or foamed or sponge form, optionally further coated with carbon, a resin or an elastomer.

The developer-carrying member used in the present invention may assume a shape of a cylinder or a sheet.

In order to provide full color images giving a clearer appearance, it is preferred to use four developing devices for magenta, cyan, yellow and black, respectively, and finally effect the black development.

An image forming apparatus suitable for practicing full-color image forming method according to the present invention will be described with reference to FIG. 4.

Figure 4:
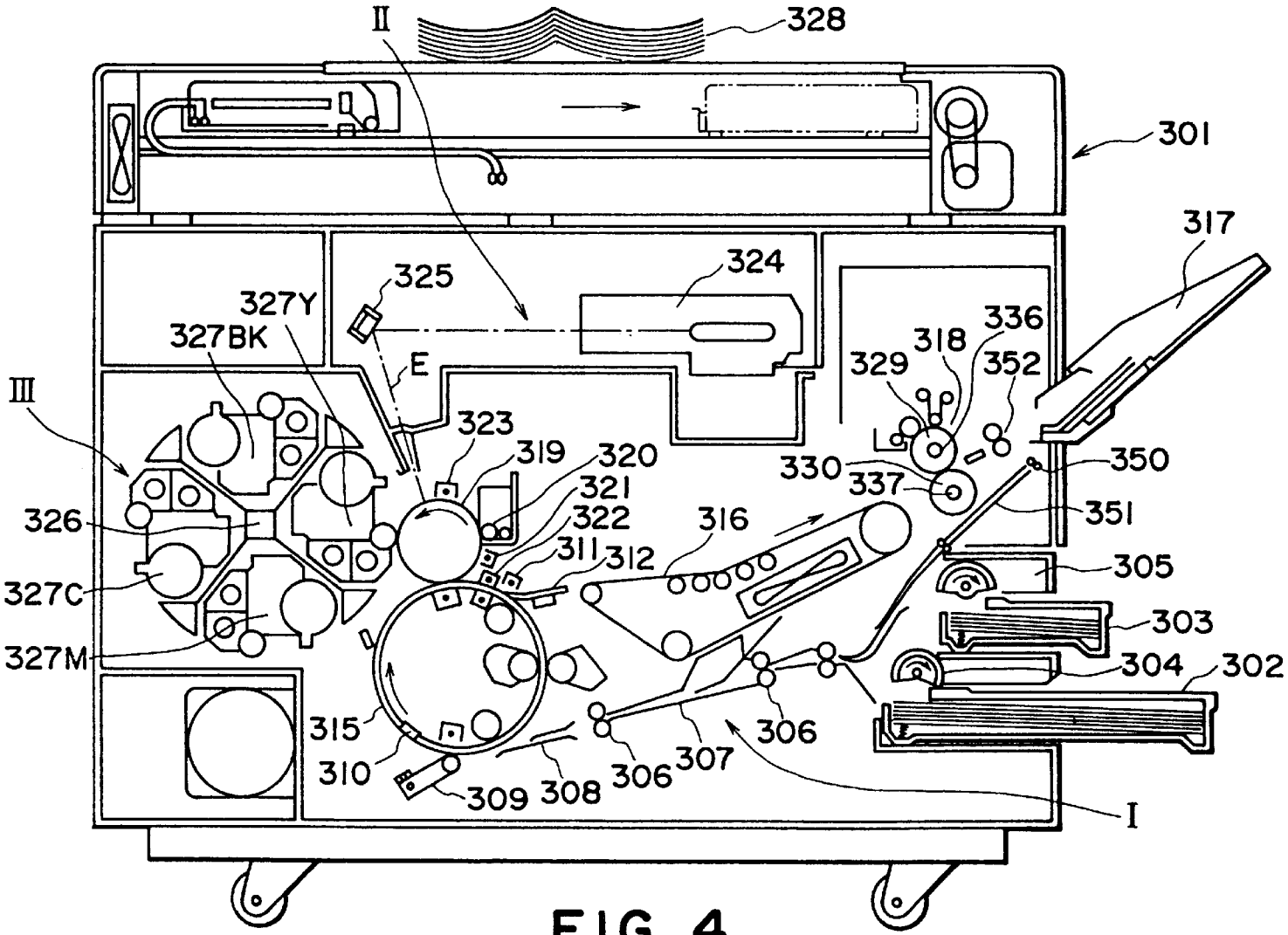
FIG. 4 is a schematic view of a full-color image forming apparatus to which the developing method according to the invention is applicable.

The color electrophotographic apparatus shown in FIG. 4 is roughly divided into a transfer material (recording sheet)-conveying section I including a transfer drum 315 and extending from the right side (the right side of FIG. 4) to almost the central part of an apparatus main assembly 301, a latent image-forming section II disposed close to the transfer drum 315, and a developing means (i.e., a rotary developing apparatus) III.

The transfer material-conveying section I is constituted as follows. In the right wall of the apparatus main assembly 301, an opening is formed through which are detachably disposed transfer material supply trays 302 and 303 so as to protrude a part thereof out of the assembly. Paper (transfer material)-supply rollers 304 and 305 are disposed almost right above the trays 302 and 303. In association with the paper-supply rollers 304 and 305 and the transfer drum 315 disposed leftward thereof so as to be rotatable in an arrow A direction, paper-supply rollers 306, a paper-supply guide 307 and a paper-supply guide 308 are disposed. Adjacent to the outer periphery of the transfer drum 315, an abutting roller 309, a glipper 310, a transfer material separation charger 311 and a separation claw 312 are disposed in this order from the upperstream to the downstream alone the rotation direction.

Inside the transfer drum 315, a transfer charger 313 and a transfer material separation charger 314 are disposed. A portion of the transfer drum 315 about which a transfer material is wound about is provided with a transfer sheet (not shown) attached thereto, and a transfer material is closely applied thereto electrostatically. On the right side above the transfer drum 315, a conveyer belt means 316 is disposed next to the separation claw 312, and at the end (right side) in transfer direction of the conveyer belt means 316, a fixing device 318 is disposed. Further downstream of the fixing device is disposed a discharge tray 317 which is disposed partly extending out of and detachably from the main assembly 301.

The latent image-forming section II is constituted as follows. A photosensitive drum (e.g., an OPC photosensitive drum) as a latent image-bearing member rotatable in an arrow direction shown in the figure is disposed with its peripheral surface in contact with the peripheral surface of the transfer drum 315. Generally above and in proximity with the photosensitive drum 319, there are sequentially disposed a discharging charger 320, a cleaning means 321 and a primary charger 323 from the upstream to the downstream in the rotation direction of the photosensitive drum 319. Further, an imagewise exposure means including, e.g., a laser 324 and a reflection means like a mirror 325, is disposed so as to form an electrostatic latent image on the outer peripheral surface of the photosensitive drum 319.

The rotary developing apparatus III is constituted as follows. At a position opposing the photosensitive drum 319, a rotatable housing (hereinafter called a "rotary member") 326 is disposed. In the rotary member 326, four-types of developing devices are disposed at equally distant four radial directions so as to visualize (i.e., develop) an electrostatic latent image formed on the outer peripheral surface of the photosensitive drum 319. The four-types of developing devices include a yellow developing device 327Y, a magenta developing device 327M, a cyan developing apparatus 327C and a black developing apparatus 327BK.

The entire operation sequence of the above-mentioned image forming apparatus will now be described based on a full color mode. As the photosensitive drum 319 is rotated in the arrow direction, the drum 319 is charged by the primary charger 323. In the apparatus shown in FIG. 3, the moving peripheral speeds (hereinafter called "process speed") of the respective members, particularly the photosensitive drum 319, may be at least 100 mm/sec, (e.g., 130–250 mm/sec). After the charging of the photosensitive drum 319 by the primary charger 323, the photosensitive drum 329 is exposed imagewise with laser light modulated with a yellow image signal from an original 328 to form a corresponding latent image on the photosensitive drum 319, which is then developed by the yellow developing device 327Y set in position by the rotation of the rotary member 326, to form a yellow toner image.

A transfer material (e.g., plain paper) sent via the paper supply guide 307, the paper supply roller 306 and the paper supply guide 308 is taken at a prescribed timing by the glipper 310 and is wound about the transfer drum 315 by means of the abutting roller 309 and an electrode disposed opposite the abutting roller 309. The transfer drum 315 is rotated in the arrow A direction in synchronism with the photosensitive drum 319 whereby the yellow toner image formed by the yellow-developing device is transferred onto the transfer material at a position where the peripheral surfaces of the photosensitive drum 319 and the transfer drum 315 abut each other under the action of the transfer charger 313. The transfer drum 315 is further rotated to be prepared for transfer of a next color (magenta in the case of FIG. 4).

On the other hand, the photosensitive drum 319 is charge-removed by the discharging charger 320, cleaned by a cleaning blade or cleaning means 321, again charged by the primary charger 323 and then exposed imagewise based on a subsequent magenta image signal, to form a corresponding electrostatic latent image. While the electrostatic latent image is formed on the photosensitive drum 319 by imagewise exposure based on the magenta signal, the rotary member 326 is rotated to set the magenta developing device 327M in a prescribed developing position to effect a development with a magenta toner. Subsequently, the above-mentioned process is repeated for the colors of cyan and black, respectively, to complete the transfer of four color toner images. Then, the four color-developed images on the transfer material are discharged (charge-removed) by the chargers 322 and 314, released from holding by the glipper 310, separated from the transfer drum 315 by the separation claw 312 and sent via the conveyer belt 316 to the fixing device 318, where the four-color toner images are fixed under heat and pressure. Thus, a series of full color print or image formation sequence is completed to provide a prescribed full color image on one surface of the transfer material.

Alternatively, the respective color toner images can be once transferred onto an intermediate transfer member and then transferred to a transfer material to be fixed thereon.

The fixing speed of the fixing device is slower (e.g., at 90 mm/sec) than the peripheral speed (e.g., 160 mm) of the photosensitive drum. This is in order to provide a sufficient heat quantity for melt-mixing yet un-fixed images of two to four toner layers. Thus, by performing the fixing at a slower speed than the developing, an increased heat quantity is supplied to the toner images.

Now, methods for measuring various properties referred to herein will be described.

Particle size of carrier

At least 200 particles (diameter of 0.1 $\mu$m or larger) are taken at random from a sample carrier and photographed through a scanning electron microscope at a magnification of 100–5000. Each enlarged photograph is placed on a tablet (available from Wacom Co.) connected to a computer, and the tablet is manipulated manually to measure the horizontal FERE diameter of each particle as a particle size, thereby obtaining a number-basis particle size distribution including a standard deviation a and a number-average particle size (Dn), from which the number-basis proportion of particles having sizes in the range of at most a half of the number-average particle size ($\leqq$½Dn %) is calculated.

Magnetic properties of a magnetic carrier

Measured by using an oscillating magnetic field-type magnetic property automatic recording apparatus ("BHV-30", available from Riken Denshi K.K.). A magnetic carrier is placed in an external magnetic field of 1 kilo-oersted to measure its magnification. The magnetic carrier powder sample is sufficiently tightly packed in a cylindrical plastic cell so as not to cause movement of carrier particles during the movement. In this state, a magnetic moment is measured and divided by an actual packed sample weight to obtain a magnetization (emu/g). Then, the true density of the carrier particles is measured by a dry-type automatic density meter ("Accupic 1330", available from Simazu Seisakusho K.K.) and the magnetization (emu/g) is multiplied by the true density to obtain a magnetization per volume (emu/cm$^3$).

Measurement of (electrical) resistivity of carrier

Figure 2:
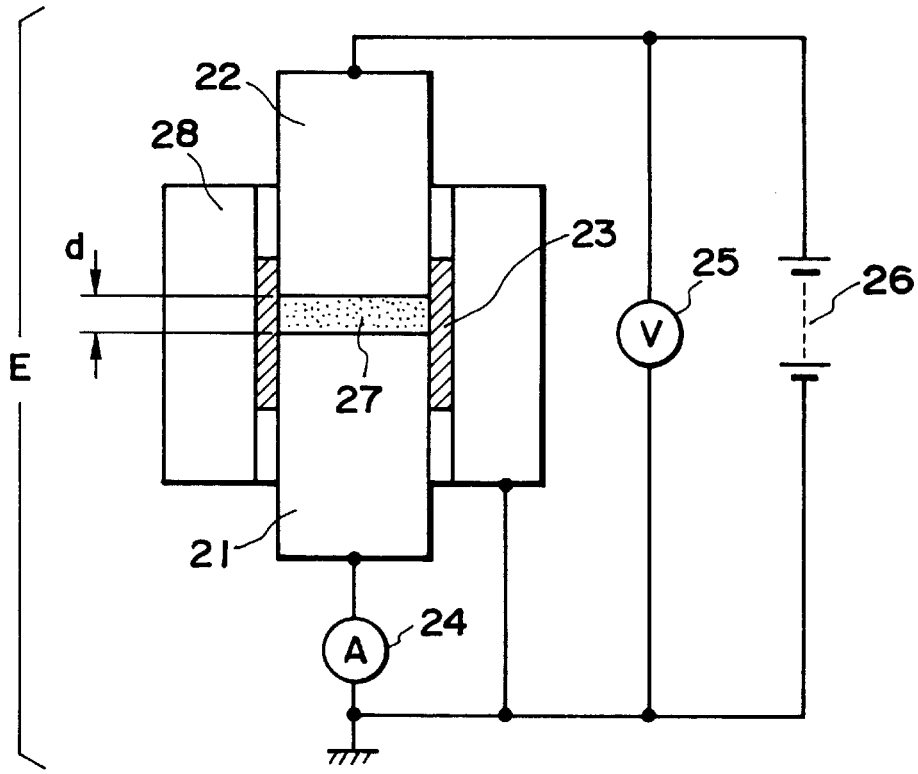
FIG. 2 is an illustration of an apparatus for measuring the (electrical) resistivity of a carrier, a carrier core, and a non-magnetic metal oxide.

The resistivity of a carrier or a carrier core is measured by using an apparatus (cell) E as shown in FIG. 2 equipped with a lower electrode 21, an upper electrode 22, an insulator 23, an ammeter 24, a voltmeter 25, a constant-voltage regulator 26 and a guide ring 28. For measurement, the cell E is charged with ca. 1 g of a sample carrier 27, in contact with which the electrodes 21 and 22 are disposed to apply a voltage therebetween, whereby a current flowing at that time is measured to calculate a resistivity. As a magnetic carrier is in powder form so that care should be taken so as to avoid a change in resistivity due to a change in packing state. The resistivity values described herein are based on measurement under the conditions of the contact area S between the carrier 27 and the electrode 21 or 12=ca. 2.3 $cm^2$, the carrier thickness d=ca. 2 mm, the weight of the upper electrode 22=180 g, and the applied voltage=100 volts.

Particle size of metal oxide

Photographs at a magnification of 5,000–20,000 of a sample metal oxide powder are taken through a transmission electron microscope ("H-800", available from Hitachi Seisakusho K.K.). At least 300 particles (diameter of 0.01 $\mu$m or larger) are taken at random in the photographs and subjected to analysis by an image analyzer ("Luzex 3", available from Nireco K.K.) to measure a horizontal FERE diameter of each particle as its particle size. From the measured values for the at least 300 sample particles, a number-average particle size is calculated.

[Resistivity of metal oxide]

Measured similarly as the above-mentioned resistivity measurement for a carrier.

[Exposure density of metal oxide at carrier surface]

The density of exposure of metal oxide particles at the carrier surface of coated magnetic carrier particles is measured by using enlarged photographs at a magnification of 5,000–10,000 taken through a scanning electron microscope ("S-800", available from Hitachi Seisakusho K.K.) at an accelerating voltage of 1 kV. Each coated magnetic carrier particle is observed with respect to its front hemisphere to count the number of exposed metal oxide particles (i.e., the number of metal oxide particles protruding out of the surface) per unit area. Protrusions having a diameter of 0.01 $\mu$m or larger may be counted. This operation is repeated with respect to at least 300 coated metal oxide particles to obtain an average value of the number of exposed metal oxide particles per unit area.

[Crosslinked resin content in carrier]

A prescribed amount of a sample carrier is calcined at 500° C. for 2 hours to determine the calcination weight loss as a total resin content. On the other hand, a similar prescribed amount of the sample carrier is soaked for dissolution within tetrahydrofuran (THF) for 2 hours and, after drying, the dissolution weight loss is determined as a non-crosslinked resin content. The crosslinked resin content ($R_{CL}$) is determined according to the following equation:

Crosslinked resin content (%)=[((total resin content)−(non-crosslinked resin content))/(total resin content9]×100(%)

[Particle size of toner]

Into 100–150 ml of an electrolyte solution (1%-NaCl aqueous solution), 0.1–5 ml of a surfactant (alkylbenzenesulfonic acid salt) is added, and 2–20 mg of a sample toner is added. The sample suspended in the electrolyte liquid is subjected to a dispersion treatment for 1–3 min. and then to a particle size distribution measurement by a laser scanning particle size distribution analyzer ("CIS-100", available from GALAI Co.). Particle in the size range of 0.5 $\mu$m–60 $\mu$m are measured to obtain a number-average particle size (D1) and a weight-average particle size (D4) by computer processing. From the number-basis distribution, the percentage by number of particles having sizes of at most a half of the number-average particle size is calculated. Similarly, from the volume-basis distribution, the percentage by volume of particles having sizes of at least two times the weight-average particle size is calculated.

[Residual monomer content (Mres) in toner]

0.2 g of a sample toner is dissolved in 4 ml of THF and the solution is subjected to gas chromatography under the following conditions to measure the monomer content according to the internal standard method.

Apparatus: Shimazu GC-15A

Carrier: $N_2$, 2 kg/$cm^2$, 50 ml/min., split ratio=1:60, linear velocity=30 mm/sec.

Column: ULBON HR-1, 50 mm×0.25 mm

| | |
|---|---|
| Temperature rise: | held at 50° C. for 5 min., raised to 100° C. at 5° C./min., raised to 200° C. at 10° C./min. and held at 200° C. |
| Sample volume: | 2 $\mu$l |
| Standard sample: | toulene |

Sample volume: 2 $\mu$l

Standard sample: toluene

[Triboelectric charge]

5 wt. parts of a toner and 95 wt. parts of a magnetic carrier are and the mixture is subjected to mixing for 60 sec. by a Turbula mixer. The resultant powder mixture (developer) is placed in a metal container equipped with a 635-mesh electroconductive screen at the bottom, and the toner in the developer is selectively removed by aspirating at a suction pressure of 250 mmHg through the screen by operating an aspirator. The triboelectric charge Q of the toner is calculated from a weight difference before and after the suction and a voltage resulted in a capacitor connected to the container based on the following equation:

$$Q(\mu C/g)=(C\times V)/(W_1-W_2),$$

wherein $W_1$ denotes the weight before the suction, $W_2$ denotes the weight after the suction, C denotes the capacitance of the capacitor, and V denotes the potential reading at the capacitor.

Hereinbelow, the present invention will be described more specifically based on Examples.

Example 1

| | |
|---|---|
| Phenol (phenyl hydroxide) | 7.5 wt. parts |
| Formalin solution (containing ca. 40 wt % of formaldehyde, ca. 10 wt. % of methanol, and remainder of water) | 11.25 " |
| Magnetite (lipophilized, treated with 1.0 wt. % of γ-aminopropyltrimethoxy-silane) (magnetic metal oxide particles, Dav. (average particle size) = 0.25 $\mu$m, Rs (resistivity) = 5.1 × $10^5$ ohm.cm) | 53 wt. parts |
| α-$Fe_2O_3$ (lipophilized with 1.0 wt. part of γ-aminopropyltrimethoxy-silane) (non-magnetic metal oxide particles, Dav. = 0.60 $\mu$m, Rs = 7.8 × $10^9$ ohm.cm) | 35 wt. parts |

(The lipophilization for the magnetic and α-$Fe_2O_3$ (hematite) was performed by adding 1.0 wt. part of γ-aminotrimethoxysilane to 99 wt. parts of magnetite or 99 wt. parts of $\alpha$-$Fe_2O_3$, and each mixture was stirred at 100° C. for 30 min. in a Henschel mixer.)

The above materials and 11 wt. parts of water were blended for 1 hour at 40° C. To the resultant slurry in a flask, 2.0 wt. parts of 28 wt. % ammonia water (basic catalyst) and 11 wt. parts of water were added and, under stirring for mixing, the content was heated to 85° C. in 40 min., followed by holding at that temperature for 3 hours of formation and curing of a phenolic resin. Then, the content was cooled to 30° C., and 100 parts of water was added thereto, followed by removal of the supernatant and washing with water and drying in air of the precipitate. The dried precipitate was further dried at 180° C. at a reduced pressure of at most 5 mmHg, thereby to obtain spherical magnetic carrier core particles containing the magnetite and the hematite in a phenolic resin binder. The particles were caused to pass through a 60 mesh-sieve and a 100 mesh-sieve to remove the coarse particle fraction, and then to removal of fine and coarse powder fraction by using a multi-division pneumatic classifier utilizing the Coanda effect ("Elbow Jet Labo EJ-L-3", available from Nittetsu Kogyo K.K.), thereby to recover carrier core particles having a number-average particle size (Dn) of 31 μm. The thus-obtained magnetic carrier core particles exhibited a crosslinked resin content ($R_{CL}$)=99% and a resistivity (Rs)=$2.2\times10^{12}$ ohm.cm.

100 wt. parts of the carrier core particles were surface-coated with a silicone resin composition comprising 0.5 wt. part of a straight silicone resin of which substituents were all methyl groups and 0.025 wt. part of γ-aminopropyltrimethoxysilane in the following manner. First, the above silicone resin composition was dissolved at a concentration of 10 wt. % in toluene to form a carrier coating solution. The coating solution was mixed with the carrier core particles while continuously applying a shearing force to vaporize the solvent, thereby effecting the coating. The resultant coated carrier particles were subjected to 2 hours of curing at 180° C. and, after disintegration, caused to pass through a 100 mesh-sieve, thereby selectively removing agglomerated coarse particles and then removal of fine and coarse powder fractions by the multi-division pneumatic classifier, thereby to obtain magnetic coated Carrier No. 1, which exhibited Dn=31 μm, a particle size distribution containing 0.5% by number of particles having sizes of at most ⅔·Dn (i.e., ≦⅔·Dn %=0.5% N), and Dn/σ=5.5.

Carrier No. 1 further exhibited Rs=$3.1\times10^{13}$ ohm.cm, SF-1=104, a magnetization at 1 kilo-oersted ($\sigma_{1000}$) of 130 emu/cm$^3$ and a true specific gravity (SG) of 3.47 g/cm$^3$.

As a result of observation through an electron microscope and determination by an image processor, Carrier No. 1 exhibited an average surface exposure density of metal oxide (denoted by MO-exposure rate) of 2.3 (particles)/μm$^2$.

Physical properties of Carrier No. 1 (magnetic coated carrier) are summarized in Table 1 together with those of other Carriers described hereinafter.

Example 2

Magnetic carrier core particles having Dn=35 μm were prepared in the same manner as in Example 1 except for changing the amount of the lipophilization agent (γ-aminopropyltriethoxysilane) from 1.0 wt. % to 0.5 wt. %. The magnetic carrier core particles exhibited $R_{CL}$=98%, and Rs=$1.5\times10^{12}$ ohm.cm.

By effecting a silicone resin coating similarly as in Example 1, Carrier No. 2 (magnetic coated carrier) was obtained. Carrier No. 2 showed Dn =35 μm, ≦⅔·Dn %=ca. 1.0% N, Dn/σ=6.3 but showed a slightly increased amount of fine powder. Carrier No. 2 further showed Rs=$1.3\times10^{13}$ ohm.cm, SF-1=104, $\sigma_{1000}$=131 emu/cm$^3$, SG=3.49 g/cm$^3$, and MO-exposure rate =4.1/μm$^2$.

Comparative Example 1

Magnetic carrier core particles having Dn=30 μm were prepared in the same manner as in Example 1 except for changing the $\alpha$-$Fe_2O_3$ with lipophilized $\alpha$-$Fe_2O_3$ (Dav.= 0.20 μm, Rs=$2\times10^9$ ohm.cm) having a smaller average particle size (Dav.). The magnetic carrier core particles exhibited $R_{CL}$=99%, and Rs=$5.8\times10^8$ ohm.cm.

By effecting a silicone resin coating similarly as in Example 1, Carrier No. 3 (magnetic coated carrier) was obtained. Carrier No. 3 showed Dn=30 μm, ≦⅔·Dn %=0% N, Dn/σ=5.5. Carrier No. 3 further showed Rs=$7.2\times10^{10}$ ohm.cm, SF-1=106, $\sigma_{1000}$=132 emu/cm$^3$, SG=3.51 g/cm$^3$, and MO-exposure rate=11.6/μm$^2$.

| Example 3 | |
|---|---|
| Phenol | 7.5 wt. parts |
| Formalin solution (Same as in Example 1) | 11.25 " |
| Magnetite (lipophilized, Same as in Example 1) | 44 " |
| $\alpha$-$Fe_2O_3$ (lipophilized, Same as in Example 1) | 44 " |

The above materials, 2.0 wt. parts of 28 wt. % ammonia water (basic catalyst) and 30 wt. parts of water were placed in a flask (without preliminary blending) and, under stirring for mixing, heated to 85° C. in 30 min., followed by holding at that temperature for 3 hours of curing reaction. Thereafter, polymerizate particles were subjected to post treatments in the same manner as in Example 1 to obtain magnetic carrier core particles, which exhibited Dn=38 μm, $R_{CL}$99%, and Rs=$5.8\times10^{12}$ ohm.cm.

The magnetic carrier core particles were subjected to a similar silicone resin coating as in Example 1 to prepare Carrier No. 4.

The thus-obtained Carrier No. 4 exhibited Dn=38 μm, ≦⅔·Dn %=Ca. 9% N, Dn/σ=3.9 indicating a somewhat broader particle size distribution.

Carrier No. 4 further exhibited Rs=$5.0\times10^{13}$ ohm.cm, SF-1=104, $\sigma_{1000}$=103 emu/cm$^3$, SG=3.53 g/cm$^3$, and MO-exposure rate=4.5/μm$^2$.

| Example 4 | |
|---|---|
| Phenol | 7.5 wt. parts |
| Formalin solution (Same as in Example 1) | 11.25 " |
| Magnetite (lipophilized with 1.0 wt. % of γ-aminopropyltrimethoxysilane) (Dav. = 0.24 μm, Rs = $5\times10^5$ ohm.cm) | 44 " |
| $\alpha$-$Fe_2O_3$ (lipophilized with 1.0 wt. % of γ-aminopropyltrimethoxysilane) (Dav. = 0.60 μm, Rs = $2\times10^9$ ohm.cm) | 44 " |

The above materials and 9 wt. parts of water were blended for 1 hour at 40° C. To the resultant slurry in a flask, 2.2 wt. parts of 28 wt. % ammonia water (basic catalyst) and 9 wt.

parts of water were added and, under stirring for mixing, the mixture was heated to 85° C. in 40 min. and held at that temperature for 3 hours to effect reaction and curing. Then, the content was cooled to 30° C., and 100 wt. parts of water was added thereto, followed by removal of the supernatant and washing with water and drying in air of the precipitate. The dried precipitate was further dried at 180° C. at a reduced pressure (at most 5 mmHg) to obtain spherical magnetic carrier core particles containing magnetite and hematite in a phenolic resin binder. Then, the particles were subjected to classification in the same manner as in Example 1 to obtain magnetic carrier core particles, which exhibited Dn=20 $\mu$m, $R_{CL}$=100%, and Rs=$1.0\times10^{12}$ ohm.cm.

The magnetic carrier core particles were coated with 1 wt. part of silicone resin similarly as in Example 1 to obtain Carrier No. 5 (magnetic carrier), which exhibited Dn=20 $\mu$m, $\leqq$⅔·Dn %=ca. 1% N, Dn/σ=5.4 indicating a very sharp particle size distribution, Rs=$8.4\times10^{12}$ ohm.cm, SF-1=104, $\sigma_{1000}$=140 emu/cm$^3$, SG=3.48 g/cm$^3$ and MO-exposure rate=6.6/$\mu$m$^2$.

| Example 5 | |
|---|---|
| Melamine | 7.5 wt. parts |
| Formalin solution (Same as in Example 1) | 11.25 " |
| Magnetite (lipophilized with 1.5 wt. % of isopropyltri(N-aminoethylaminoethyl)-titanate (Dav. = 0.24 $\mu$m, Rs = $5\times10^5$ ohm.cm) | 44 " |
| α-$Fe_2O_3$ (lipophilzed with 1.5 wt. % of isoproxyltri(N-aminoethylaminoethyl)-titanate) (Dav. = 0.30 $\mu$m, Rs = $3\times10^9$ ohm.cm) | 44 " |

The above materials and 15 wt. parts of water were blended for 1 hour at 40° C. To the resultant slurry in a flask, 2.5 wt. parts of 28 wt. % ammonia water (basic catalyst) and 20 wt. parts of water were added, followed thereafter by similar reaction and post treatments as in Example 1 to obtain spherical magnetic carrier core particles containing magnetite and hematite in a melamine resin binder. Then, the particles were subjected to classification in the same manner as in Example 1 to obtain magnetic carrier core particles, which exhibited Dn=58 $\mu$m, $R_{CL}$=98%, and Rs=$5.9\times10^{11}$ ohm.cm.

The magnetic carrier core particles were coated with 0.4 wt. part of silicone resin otherwise similarly as in Example 1 to obtain Carrier No. 6 (magnetic carrier), which exhibited Dn =58 $\mu$m, $\leqq$⅔·Dn %=ca. 0.8% N, Dn/σ=6.6 indicating a very sharp particle size distribution with little fine powder, Rs=$6.0\times10^{12}$ ohm.cm, SF-1=103, $\sigma_{1000}$=100 emu/cm$^3$, SG=3.50 g/cm$^3$ and MO-exposure rate=9.8/$\mu$m$^2$.

| Example 6 | |
|---|---|
| Styrene | 17 wt. parts |
| Divinylbenzene | 3 " |
| Magnetite (lipophilized with 2.0 wt. % of γ-aminopropyltrimethoxysilane) (Dav. = 0.24 $\mu$m, Rs = $5\times10^5$ ohm.cm) | 62 " |
| α-$Fe_2O_3$ (lipophilized with 2.0 wt. % of γ-aminopropyltrimethoxysilane) (Dav. = 0.60 $\mu$m, Rs = $2\times10^9$ ohm.cm) | 18 " |

The above materials 20 wt. parts of methanol and 5 wt. parts of water were blended for 1 hour at 30° C. To the resultant slurry in a flask, 20 wt. parts of methanol, 5 wt. parts of water and 1.2 wt. part of 2,2'-azobisisobutyronitrile were added and, under stirring for mixing, the mixture was heated to 64° C. in 20 min. and held at that temperature for 10 hours to effect reaction and curing. Then, the content was cooled to 30° C., and 200 wt. parts of methanol/water mixture was added thereto, followed by removal of the supernatant and washing with water and drying in air of the precipitate. The dried precipitate was further dried at 120° C. at a reduced pressure (at most 5 mmHg) to obtain spherical magnetic carrier core particles containing magnetite and hematite in a crosslinked polystyrene resin binder. Then, the particles were subjected to classification in the same manner as in Example 1 to obtain magnetic carrier core particles, which exhibited Dn=32 $\mu$m, $R_{CL}$=86%, and Rs=$3.3\times10^{11}$ ohm.cm.

The magnetic carrier core particles were coated with silicone resin similarly as in Example 1 to obtain Carrier No. 7 (magnetic carrier), which exhibited Dn=32 $\mu$m, $\leqq$⅔·Dn %=ca. 1.4% N, Dn/σ=5.4, Rs=$9.9\times10^{12}$ ohm.cm, SF-1=105, $\sigma_{1000}$=112 emu/cm$^3$, SG=2.78 g/cm$^3$ and MO-exposure rate=7.4/$\mu$m$^2$.

Comparative Example 2

100 wt. parts of polyester resin, 500 wt. parts of magnetite powder, 2 wt. parts of carbon black and 1.5 wt. part of silica were sufficiently blended and melt-kneaded in a pressurized kneader. After cooling, the melt-kneaded product was coarsely crushed by a feathermill and finely pulverized by a jet mill including a collision plate having a shape of truncated cone (an apex angle of the removed cone of 120 deg., providing a trapezoidal transverse section) under a pulverization air pressure of 2.5 kg.f/cm$^2$, followed by classification by a multiplexer to obtain Carrier No. 8 (magnetic un-coated carrier), which exhibited Dn=31 $\mu$m, $R_{CL}$=1%, Rs=$2.2\times10^8$ ohm.cm, $\leqq$⅔·Dn %=ca. 23.6% N, Dn/σ=2.3, SF-1=145, $\sigma_{1000}$=162 emu/cm$^3$, SG=3.02 g/cm$^3$, and MO-exposure rate=20.4 $\mu$m$^2$.

Comparative Example 3

Metal oxides were weighed in mol ratios of $Fe_2O_3$=50 mol. %, CuO=25 mol. % and ZnO=25 mol. %) and blended by a ball mill. The blend was calcined, pulverized by a ball mill and formed into particles by a spray drier. The particles were then sintered and, after cooling, subjected to pneumatic classification to obtain magnetic carrier core particles, which exhibited Dn=30 $\mu$m and Rs=$4.0\times10^8$ ohm.cm.

The carrier core particles were subjected to coating with a straight silicone resin composition similarly as in Example 1, to obtain Carrier No. 9 (magnetic coated carrier), which exhibited Dn=30 $\mu$m, $\leqq$⅔·Dn %=ca. 22.7% N, Dn/σ=2.38, Rs=$1.1\times10^{10}$ ohm.cm, SF-1=116, $\sigma_{1000}$=289 emu/cm$^3$, and SG=5.02 g/cm$^3$.

Reference Example

Carrier No. 10 (magnetic coated carrier) was prepared in the same manner as in Example 1 except for using the magnetite particles and $\alpha$-$Fe_2O_3$ particles without the lipophilization treatment to obtain magnetic carrier core particles and coating the magnetic carrier core particles with straight silicone resin composition similarly as in Example 1 except for omitting the classification by the multi-division classifier after the coating steps.

The properties of Carrier Nos. 1–10 are inclusively shown in the following Table 1.

TABLE 1

| | Properties of Carriers | | | | | | | | | | |
|---|---|---|---|---|---|---|---|---|---|---|---|
| | Resistivity Rs | | | Particle size distribution | | | | | MO- | | |
| | Core particles (ohm.cm) | Coated carrier (ohm.cm) | Dn ($\mu$m) | ≦2/3 · Dn % (% by number) | σ | Dn/σ | $R_{CL}$ of binder (%) | SF-1 | exposure rate (-/$\mu m^2$) | σ1000 (emu/$cm^3$) | SG (g/$cm^3$) |
| 1 (Ex.) | $2.2 \times 10^{12}$ | $3.1 \times 10^{13}$ | 31.14 | 0.5 | 5.65 | 5.51 | 99 | 104 | 2.3 | 130 | 3.47 |
| 2 (Ex.) | $1.5 > 10^{12}$ | $1.3 \times 10^{13}$ | 35.01 | 0 | 5.52 | 6.34 | 98 | 104 | 4.1 | 131 | 3.49 |
| 3 (Comp.) | $5.8 \times 10^{8}$ | $7.2 \times 10^{10}$ | 30.14 | 0 | 5.45 | 5.53 | 99 | 106 | 11.6 | 132 | 3.51 |
| 4 (Ex.) | $5.8 \times 10^{12}$ | $5.0 \times 10^{13}$ | 38.40 | 9 | 9.80 | 3.91 | 99 | 104 | 4.5 | 103 | 3.53 |
| 5 (Ex.) | $1.0 \times 10^{12}$ | $8.4 \times 10^{12}$ | 20.00 | 1 | 3.70 | 5.41 | 100 | 104 | 6.6 | 140 | 3.48 |
| 6 (Ex.) | $5.9 \times 10^{11}$ | $6.0 \times 10^{12}$ | 58.20 | 0.8 | 8.75 | 6.65 | 98 | 103 | 9.8 | 100 | 3.50 |
| 7 (Ex.) | $3.3 \times 10^{11}$ | $9.9 \times 10^{12}$ | 32.79 | 1.4 | 6.03 | 5.44 | 86 | 105 | 7.4 | 112 | 2.78 |
| 8 (Comp.) | $2.2 \times 10^{8}$ | — | 31.75 | 23.6 | 13.58 | 2.34 | 1 | 145 | 20.4 | 162 | 3.02 |
| 9 (Comp.) | $4.0 \times 10^{8}$ | $1.1 \times 10^{10}$ | 30.22 | 22.7 | 12.72 | 2.38 | — | 116 | — | 289 | 5.02 |
| 10 (Ref.) | $2.2 \times 10^{12}$ | $3.1 \times 10^{13}$ | 31.0 | 13.0 | 13.0 | 2.4 | 99 | 105 | 2.3 | 130 | 3.47 |

Toner Production Example 1

Into 710 wt. parts of deionized water, 450 wt. parts of 0.1 M—$Na_3PO_4$ aqueous solution was charged and warmed at 60° C. under stirring at 12,000 rpm by a high-speed stirrer ("TK-Homomixer", available from Tokushu Kika Kogyo K.K.). Then, 68 wt. parts of 1.0 M—$CaCl_2$ aqueous solution was gradually added to the system to obtain an aqueous medium containing $Ca_3(PO_4)_2$. Separately, a monomer composition was prepared in the following manner.

| | |
|---|---|
| Styrene | 165 wt. parts |
| n-Butyl acrylate | 35 wt. parts |
| C.I. Pigment Blue 15:3 (colorant) | 15 wt. parts |
| Dialkylsalicylic acid metal compound (charge control agent) | 5 wt. parts |
| Saturated polyester | 10 wt. parts |
| Ester wax (melting point Tm.p = 70° C.) | 50 wt. parts |

The above ingredients were warmed at 60° C. and subjected to uniform dissolution and dispersion under stirring at 11,000 rpm (by TK-Homomixer), and then 10 wt. parts of 2,2'-azobis(2,4-dimethyl-valeronitrile) (polymerization initiator) was dissolved therein to form a polymerizable monomer composition.

Into the above-prepared aqueous medium, the polymerizable monomer composition was charged, and the system was stirred at 11,000 rpm (by TK-Homomixer) for 10 min. at 60° C. in an $N_2$-environment to disperse the composition into a particulate form. (This step is hereinafter referred to a "particulation".) Then, the system was stirred by a paddle stirrer and heated to 80° C. to effect polymerization for 10 hours. After the polymerization, the system was subjected to distilling-off of the residual monomer under a reduced pressure, cooling, addition of hydrochloric acid to dissolve the calcium phosphate, filtration, washing with water and drying to obtain cyan toner particles.

To 100 wt. parts of the cyan toner particles, 1.6 wt. part of hydrophobic silica fine powder having a specific surface area according to the BET method ($S_{BET}$) of 200 $m^2/g$ was externally added to prepare Cyan Toner A (suspension polymerization toner). Cyan Toner A exhibited a weight average particle size (D4) of 6.0 $\mu$m, a number-average particle size (D1) of 4.7 $\mu$m, a percentage (cumulative) by number of particles having sizes of at most a half of D1 (hereinafter denoted by "≦½·D1%") of 6.9% N ("% N" represents a percent by number), and a percentage (cumulative) % volume of particles having sizes of at least two times D4 (hereinafter denoted by "≦2·D4%") of 0% V ("% V" represents % by volume), a shape factor SF-1 of 103, a residual monomer content (Mres) of 400 ppm. The toner particles had a core/shell structure enclosing the ester was at the core.

Toner Production Example 2

Cyan toner particles were prepared from the same starting material composition in the same manner as in Toner Production Example 1 except that the stirring speed in the particulation step was changed to 13,000 rpm (by TK-Homomixer). The toner particles were then blended with 2.5 wt. parts of hydrophilized titanium oxide fine powder ($S_{BET}$=200 $m^2/g$) to obtaining Cyan Toner B.

Cyan Toner B exhibited D4=ca. 4.9 $\mu$m, D1=3.8 $\mu$m, ≦½·D1%=6.3% N, ≦2·D4=0% V, SF-1=104, and Mres=620 ppm. The ester was enclosed within the toner particles to provide core/shell structure.

| Toner Production Example 3 | |
|---|---|
| Styrene | 165 wt. parts |
| n-Butyl acrylate | 35 " |
| C.I. Pigment Blue 15:3 | 15 " |
| Dialkylsalicylic acid metal compound | 3 " |
| Saturated polyester (acid value (AV) = 14, peak molecular weight (Mp) = 8000) | 10 " |
| Ester was (Tmp = 70° C.) | 10 " |

The above ingredients were warmed at 60° C. and subjected to uniform dissolution and dispersion under stirring at 12,000 rpm (by TK-Homomixer), and 10 wt. parts of 2,2'-azobis(2,4-dimethylvaleronitrile) was dissolved to form a polymerizable monomer composition.

Into an aqueous medium identical to the one prepared in Toner Production Example 1, the above-prepared polymerizable monomer composition was charged, and the system was stirred at 11,000 rpm (by TK-Homomixer) for 10 min. at 60° C. in an $N_2$-environment to effect particulation. Then, the system was stirred by a paddle stirrer under heating at 60° C. to effect polymerization for 6 hours. After the polymerization, the system was subjected to cooling, addition of hydrochloric acid to dissolve the calcium phosphate, filtration, washing with water and drying to obtain cyan toner particles. Then, 100 wt. parts of the toner particles were blended with 1.5 wt. parts of hydrophobized titanium oxide fine powder ($S_{BET}$=200 $m^2/g$) to obtaining Cyan Toner C, which exhibited D4=ca. 6.4 μm, D1=5.0 μm, ≦½·D1%=8.1% N, ≦2·D4%=0% V, SF-1=105, and Mres=2400 ppm.

Toner Production Example 4

To 100 wt. parts of polyester resin, 5 wt. parts of C.I. Pigment Blue 15:3, 5 wt. parts of di-alkylsalicylic acid metal compound, and 5 wt. parts of low-molecular weight polypropylene were added and blended within a Henschel mixer. The blend was then melt kneaded through a twin-screw extruder while connecting its vent port to a suction pump for sucking.

The result melt-kneaded product, after cooling for solidification, coarsely crushed by a hammer mill to recover a coarse pulverizate having a size of passing a 1 mm-mesh sieve. The coarse pulverizate was then pulverized by a jet mill and then classified by a multi-division classifier ("Elbow Jet") to obtain cyan Toner particles. Then, 100 wt. parts of the toner particles were blended with 1.2 wt. parts of hydrophobized titanium oxide fine powder ($S_{BET}$=200 $m^2/g$) to obtaining Cyan Toner D, which exhibited D4=ca. 7.8 μm, D1=5.6 μm, ≦½·D1%=10.2% N, ≦2·D4% =0.3% V, SF-1=145, and Mres=440 ppm.

Toner Production Example 5

Yellow toner particles were prepared in the same manner as in Toner Production Example 1 except for replacing the cyan pigment (C.I. Pigment Blue 15:3) with 4.5 wt. parts of C.I. Pigment Yellow 17. Then, 100 wt. parts of the yellow toner particles were externally blended with 1.6 wt. part of hydrophobized titanium oxide fine particles ($S_{BET}$=200 $m^2/g$) similarly as in Toner Production Example 1 to prepare Yellow Toner E, which exhibited D4=5.9 μm, D1=4.7 μm, ≦½·D1%=6.2% N, ≦2·D4%=0% V, SF-1=102 and Mres=440 ppm. The toner particles exhibited a core/shell structure wherein the ester wax was enclosed therein.

Toner Production Example 6

Magenta toner particles were prepared in the same manner as in Toner Production Example 1 except for replacing the cyan pigment (C.I. Pigment Blue 15:3) with 5 wt. parts of C.I. Pigment Red 202. Then, 100 wt. parts of the magenta toner particles were externally blended with 1.6 wt. part of hydrophobized titanium oxide fine particles ($S_{BET}$=200 $m^2/g$) similarly as in Toner Production Example 1 to prepare Magenta Toner F, which exhibited D4=6.2 μm, D1=4.9 μm, ≦½·D1%=6.5% N, ≦2·D4%=0% V, SF-1=103 and Mres=390 ppm. The toner particles exhibited a core/shell structure wherein the ester wax was enclosed therein.

Toner Production Example 7

Non-magnetic black toner particles were prepared in the same manner as in Toner Production Example 1 except for replacing the cyan pigment (C.I. Pigment Blue 15:3) with 4 wt. parts of carbon black. Then, 100 wt. parts of black toner particles were externally blended with 1.6 wt. part of hydrophobized titanium oxide fine particles ($S_{BET}$=200 $m^2/g$) similarly as in Toner Production Example 1 to prepare Black Toner G, which exhibited D4=6.1 μm, D1=4.7 μm, ≦½·D1%=8.3% N, ≦2·D4%=0% V, SF-1=103 and Mres=480 ppm. The toner particles exhibited a core/shell structure wherein the ester wax was enclosed therein.

The properties of Toners A–G are shown in the following Table 2.

TABLE 2

| Toner | D4 (μm) | D1 (μm) | ≦½ · D1% (% by number) | ≧2 · D4% (% by volume) | SF-1 | Residual monomer Mres (ppm) |
|---|---|---|---|---|---|---|
| Cyan A | 6.0 | 4.7 | 6.9 | 0 | 103 | 400 |
| Cyan B | 4.9 | 3.8 | 6.3 | 0 | 104 | 620 |
| Cyan C | 6.4 | 5.0 | 8.1 | 0 | 105 | 2400 |
| Cyan D | 7.8 | 5.6 | 10.2 | 0.3 | 145 | 440 |
| Yellow E | 5.9 | 4.7 | 6.2 | 0 | 102 | 440 |
| Magenta F | 6.2 | 4.9 | 6.5 | 0 | 103 | 390 |
| Black G | 6.1 | 4.7 | 8.3 | 0 | 013 | 480 |

Example 7

Four two-component type developers for magnetic brush development were prepared by mixing Carrier No. 1 (magnetic coated carrier) with Cyan Toner A, Yellow Toner E, Magenta Toner F and Black Toner G, respectively, so as to provide a toner concentration of 8.0 wt. % each.

The developers in four colors were charged in a full-color laser copier ("CLC-500", available from Canon K.K.) in a remodeled form so as to have developing devices each as shown in FIG. 1. Referring to FIG. 1, each developing device was designed to have a spacing A of 550 μm between a developer carrying member (developing sleeve) 1 and a developer-regulating member (magnetic blade) 2, and a gap B of 500 μm between the developing sleeve 1 and an electrostatic latent image-bearing member (photosensitive drum) 3 having a polytetrafluoro-ethylene-dispersed surface protective layer. A developing nip C at that time was 5.5 mm. The developing sleeve 1 and the photosensitive drum 3 were driven at a peripheral speed ratio of 2.0:1. A developing pole S1 of the developing sleeve was designed to provide a magnetic field of 1 kilo-oersted, and the developing conditions included an alternating electric field of a rectangular waveform having a peak-to-peak voltage of 2000 volts and a frequency of 2200 Hz, a developing bias of −450 volts, a toner developing contrast (Vcont) of 330 volts (absolute value), a fog removal voltage (Vback) of 80 volts (absolute value), and a primary charge voltage on the photosensitive drum of −530 volts. The developer sleeve was composed of a 25 mm-dia. cylindrical sleeve of SUS (mfd. by Hitachi Kinzoku K.K.) of which the surface had been sand-blasted (by means of "Pneumablaster", available from Fuji Seisakusho K.K.) to have Ra=2.1 μm and Sm=29.7 μm (Ra/Sm=0.07). By using the developing device including the blasted developing sleeve under the above-mentioned developing conditions, a digital latent image (spot diameter=64 μm) on the photosensitive drum 3 was developed by a reversal development mode. The developing device included a hot fixing roller surfaced with a fluorine-containing resin, which was used without application of a release oil.

As a result, the resultant images exhibited high solid-part image densities of 1.51 for cyan, 1.56 for yellow, 1.53 for magenta and 1.52 for black and good halftone reproducibilities for the respective colors. Further, no image disorder due to carrier attachment or fog at non-image portion was observed.

Further, a continuous image formation on 40,000 sheets was performed. Thereafter, an image formation test was performed similarly as in the initial stage. The resultant images showed solid-part image densities of 1.52, 1.55, 1.52 and 1.50 for cyan, yellow, magenta and black, respectively, which were high without change from the initial stage and good halftone reproducibility. No carrier attachment was observed either. As a result of observation through a SEM (scanning electron microscope) of the cyan-colored two-component type developer, the carrier particles therein exhibited a surface state which was substantially identical to that in the initial stage. Further, no liberation of metal oxide particles dispersed in the carrier was observed either.

Further, even when the fog removal voltage (Vback) was increased to 180 volts, no carrier attachment was observed.

Further, the cyan developer was subjected to triboelectric chargeability measurement in environments of low temperature/low humidity (L/L=15° C./10% RH), normal temperature/normal humidity (N/N=23.5° C./60% RH), and high temperature/high humidity (H/H=30° C./80% RH) and, as a result, provided results of −30.1 μC/g, −29.0 μC/g and −27.8 μC/g, respectively, indicating a good environmental stability.

The results are inclusively shown in Tables 3 and 4 appearing hereinafter together with those of other Examples and Comparative Examples.

Example 8

Respective colors of two-component type developers were prepared in the same manner as in Example 7 except for using Carrier No. 2 instead of Carrier No. 1 and evaluated in the same manner as in Example 7.

As a result, the resultant images exhibited high solid-part image densities of 1.47 for cyan, 1.49 for yellow, 1.47 for magenta and 1.47 for black and good halftone reproducibilities for the respective colors. Further, no image disorder due to carrier attachment or fog at non-image portion was observed.

Further, as a result of the image formation test after the continuous image formation on 40,000 sheets, the resultant images showed solid-part image densities of 1.50, 1.49, 1.52 and 1.48 for cyan, yellow, magenta and black, respectively, which were high similarly as in the initial stage and good halftone reproducibility. No carrier attachment was observed either. As a result of the SEM observation of the cyan-colored two-component type developer, the carrier particles therein exhibited a surface state which was substantially identical to that in the initial stage. Further, no liberation of metal oxide particles dispersed in the carrier was observed either.

Further, the cyan developer exhibited triboelectric chargeabilities in environments of low temperature/low humidity (L/L), normal temperature/normal humidity (N/N), and high temperature/high humidity (H/H) of −30.3 μC/g, −28.8 μC/g and −27.4 μC/g, respectively, indicating a good environmental stability.

Comparative Example 4

Respective colors of two-component type developers were prepared in the same manner as in Example 7 except for using Carrier No. 3 (magnetic coated carrier, comparative) instead of Carrier No. 1 and evaluated in the same manner as in Example 7.

As a result, the resultant images exhibited high solid-part image densities of 1.45 for cyan, 1.44 for yellow, 1.45 for magenta and 1.46 for black but somewhat inferior halftone reproducibilities for the respective colors. Further, carrier attachment was observed and slight fog occurred at non-image portion.

Further, as a result of the image formation test after the continuous image formation on 40,000 sheets, the resultant images showed solid-part image densities of 1.50, 1.48, 1.47 and 1.47 for cyan, yellow, magenta and black, respectively, which were similar to those in the initial stage but exhibited inferior halftone reproducibility and carrier attachment similarly as in the initial stage.

Further, the cyan developer exhibited triboelectric chargeabilities in environments of low temperature/low humidity (L/L), normal temperature/normal humidity (N/N), and high temperature/high humidity (H/H) of −31.6 μC/g, −30.3 μC/g and −27.7 μC/g, respectively.

Example 9

Respective colors of two-component type developers (toner concentration: 7.5 wt. %, each) were prepared in a similar manner as in Example 7 except for using Carrier No. 4 instead of Carrier No. 1 and evaluated in the same manner as in Example 7.

As a result, the resultant images exhibited high solid-part image densities of 1.48 for cyan, 1.51 for yellow, 1.48 for magenta and 1.52 for black and good halftone reproducibilities for the respective colors. Further, no image disorder due to carrier attachment or fog at non-image portion was observed.

Further, as a result of the image formation test after the continuous image formation on 40,000 sheets, the resultant images showed solid-part image densities of 1.50, 1.53, 1.47 and 1.49 for cyan, yellow, magenta and black, respectively, which were high similarly as in the initial stage and good halftone reproducibility. No carrier attachment was observed either. As a result of the SEM observation of the cyan-colored two-component type developer, the carrier particles therein exhibited a surface state which was substantially identical to that in the initial stage. Further, no liberation of metal oxide particles dispersed in the carrier was observed either.

Further, the cyan developer exhibited triboelectric chargeabilities in environments of low temperature/low humidity (L/L), normal temperature/normal humidity (N/N), and high temperature/high humidity (H/H) of −31.6 μC/g, −29.6 μC/g and −27.5 μC/g, respectively, indicating a somewhat larger environment-dependence, which was however of a practically non-problematic level.

Example 10

Respective colors of two-component type developers (toner concentration: 9.5 wt. %, each) were prepared in a similar manner as in Example 7 except for using Carrier No. 5 instead of Carrier No. 1 and evaluated in the same manner as in Example 7.

As a result, the resultant images exhibited high solid-part image densities of 1.53 for cyan, 1.55 for yellow, 1.53 for magenta and 1.56 for black and very good halftone reproducibilities for the respective colors. Further, no carrier attachment or fog was observed.

Further, as a result of the image formation test after the continuous image formation on 40,000 sheets, the resultant images showed solid-part image densities of 1.52, 1.54, 1.53 and 1.52 for cyan, yellow, magenta and black, respectively, which were high similarly as in the initial stage and good halftone reproducibility. No carrier attachment or fog was observed either. As a result of the SEM observation of the cyan-colored two-component type developer, the carrier particles therein exhibited a surface state which was substantially identical to that in the initial stage. Further, no liberation of metal oxide particles dispersed in the carrier was observed either.

Further, the cyan developer exhibited triboelectric chargeabilities in environments of low temperature/low humidity (L/L), normal temperature/normal humidity (N/N), and high temperature/high humidity (H/H) of −28.8 μC/g, −27.8 μC/g and −26.0 μC/g, respectively, indicating a good environmental stability similarly as in Example 7.

Example 11

Respective colors of two-component type developers (toner concentration: 5 wt. % each) were prepared in a similar manner as in Example 7 except for using Carrier No. 6 instead of Carrier No. 1 and evaluated in the same manner as in Example 7.

As a result, the resultant images exhibited high solid-part image densities of 1.54 for cyan, 1.47 for yellow, 1.44 for magenta and 1.46 for black, and good halftone reproducibilities for the respective colors while they were somewhat inferior than those in Example 7. Further, no carrier attachment or fog was observed.

Further, as a result of the image formation test after the continuous image formation on 40,000 sheets, the resultant images showed solid-part image densities of 1.45, 1.48, 1.46 and 1.49 for cyan, yellow, magenta and black, respectively, which were high similarly as in the initial stage and good halftone reproducibility. No carrier attachment or fog was observed either. As a result of the SEM observation of the cyan-colored two-component type developer, the carrier particles therein exhibited a surface state which was substantially identical to that in the initial stage. Further, no liberation of metal oxide particles dispersed in the carrier was observed either.

Further, the cyan developer exhibited triboelectric chargeabilities in environments of low temperature/low humidity (L/L), normal temperature/normal humidity (N/N), and high temperature/high humidity (H/H) of −32.5 μC/g, −31.3 μC/g and −29.9 μC/g, respectively, indicating a good environmental stability similarly as in Example 7.

Example 12

Respective colors of two-component type developers were prepared in the same manner as in Example 7 except for using Carrier No. 7 instead of Carrier No. 1 and evaluated in the same manner as in Example 7.

As a result, the resultant images exhibited high solid-part image densities of 1.49 for cyan, 1.52 for yellow, 1.47 for magenta and 1.47 for black and good halftone reproducibilities for the respective colors similarly as in Example 7. Further, no carrier attachment or fog was observed.

Further, as a result of the image formation test after the continuous image formation on 40,000 sheets, the resultant images showed solid-part image densities of 1.50, 1.51, 1.49 and 1.50 for cyan, yellow, magenta and black, respectively, which were high similarly as in the initial stage and good halftone reproducibility. No carrier attachment or fog was observed either. As a result of the SEM observation of the cyan-colored two-component type developer, the carrier particles therein exhibited a surface state which was substantially identical to that in the initial stage. Further, no liberation of metal oxide particles dispersed in the carrier was observed either.

Further, the cyan developer exhibited triboelectric chargeabilities in environments of low temperature/low humidity (L/L), normal temperature/normal humidity (N/N), and high temperature/high humidity (H/H) of −30.5 μC/g, −28.9 μC/g and −27.0 μC/g, respectively, indicating a good environmental stability.

Comparative Example 4

Respective colors of two-component type developers were prepared in the same manner as in Example 7 except for using Carrier No. 8 (comparative) instead of Carrier No. 1 and evaluated in the same manner as in Example 7.

As a result, the resultant images exhibited high solid-part image densities of 1.44 for cyan, 1.46 for yellow, 1.45 for magenta and 1.46 for black but somewhat inferior halftone reproducibilities (accompanied with dot disorder) for the respective colors. Further, carrier attachment and fog were observed.

Further, as a result of the image formation test after the continuous image formation on 40,000 sheets, the resultant images showed solid-part image densities of 1.50, 1.51, 1.49 and 1.51 for cyan, yellow, magenta and black, respectively, which were liable to be higher than the initial stage values. The halftone reproducibility and carrier attachment were inferior similarly as in the initial stage.

Further, the cyan developer exhibited triboelectric chargeabilities in environments of low temperature/low humidity (L/L), normal temperature/normal humidity (N/N), and high temperature/high humidity (H/H) of −35.2 μC/g, −31.7 μC/g and −27.7 μC/g, respectively, indicating a large environmental dependence.

Comparative Example 6

Respective colors of two-component type developers were prepared in the same manner as in Example 7 except for using Carrier No. 9 (comparative) instead of Carrier No. 1 and evaluated in the same manner as in Example 7.

As a result, the resultant images exhibited high solid-part image densities of 1.45 for cyan, 1.46 for yellow, 1.44 for magenta and 1.45 for black but somewhat inferior halftone reproducibilities (accompanied with dot disorder) for the respective colors. Further, some carrier attachment and fog occurred.

Further, as a result of the image formation test after the continuous image formation on 40,000 sheets, the resultant images showed solid-part image densities of 1.49, 1.49, 1.47 and 1.48 for cyan, yellow, magenta and black, respectively, which were liable to be higher than in the initial. No carrier attachment was observed, but the halftone reproducibility and fog became even worse than in the initial stage. Further, the cyan developer exhibited triboelectric chargeabilities in environments of low temperature/low humidity (L/L), normal temperature/normal humidity (N/N), and high temperature/high humidity (H/H) of −33.6 μC/g, −31.5 μC/g and −27.2 μC/g, respectively, indicating a large environmental dependence.

Example 13

A two-component type cyan developer was prepared in the same manner as in Example 7 except for using Cyan Toner B instead of Cyan Toner A.

The cyan developer thus prepared was charged in the same remodeled full-color laser copier and evaluated according to a single color-mode image forming test otherwise in the same manner as in Example 7.

The resultant images showed a high solid part image density of 1.49 and a particularly excellent halftone reproducibility. No carrier attachment or fog was observed either.

Example 14

A two-component type cyan developer was prepared and evaluated in the same manner as in Example 13 except for using Cyan Toner C instead of Cyan Toner B.

Example 15

A two-component type cyan developer was prepared and evaluated in the same manner as in Example 13 except for using Cyan Toner D instead of Cyan Toner B.

Reference Example

Respective colors of two-component type developers were prepared in the same manner as in Example 7 except for using Carrier No. 10 instead of Carrier No. 1 and evaluated in the same manner as in Example 7.

The results of the above-mentioned examples are inclusively shown in the following Tables 3 and 4.

Notes to Tables 3 and 4 are inclusively given after Table 4.

TABLE 3

| | Image forming performances at initial stage | | | | | | | | | | | | | |
|---|---|---|---|---|---|---|---|---|---|---|---|---|---|---|
| | Solid-part image density Toner | | | | Halftone reproducibility Toner | | | | Fog Toner | | | | Carrier attachment Vback | |
| | Cy | Y | M | Bk | Cy | Y | M | Bk | Cy | Y | M | Bk | =80 V | =180 V |
| Ex. 7 | 1.51 | 1.56 | 1.53 | 1.52 | A | A | A | A | A | A | A | A | A | A |
| 8 | 1.47 | 1.49 | 1.47 | 1.47 | A | A | A | A | A | A | A | A | A | A |
| 9 | 1.48 | 1.51 | 1.48 | 1.52 | B | B | B | B | B | B | B | B | B | B |
| 10 | 1.53 | 1.55 | 1.53 | 1.56 | A | A | A | A | A | A | A | A | B | B |
| 11 | 1.45 | 1.47 | 1.44 | 1.46 | B | B | B | B | A | A | A | A | A | A |
| 12 | 1.49 | 1.52 | 1.47 | 1.47 | A | A | A | A | B | B | B | B | B | B |
| 13 | 1.49 | — | — | — | A | — | — | — | B | — | — | — | A | A |
| 14 | 1.46 | — | — | — | B | — | — | — | B | — | — | — | A | A |
| 15 | 1.45 | — | — | — | B | — | — | — | B | — | — | — | A | A |
| Comp. Ex. 4 | 1.45 | 1.44 | 1.45 | 1.46 | C | C | C | C | C | D | D | D | E | E |
| 5 | 1.44 | 1.46 | 1.45 | 1.46 | C | C | C | C | D | E | E | E | E | E |
| 6 | 1.45 | 1.46 | 1.44 | 1.45 | D | D | D | D | E | C | C | C | C | C |
| Ref. Ex. | 1.50 | — | — | — | A | — | — | — | A | — | — | — | A | C |

(Evaluation)
A: excellent,
B: good,
C: fair,
D: rather poor,
F: poor.

TABLE 4

| | Image forming performances after 40,000 sheets | | | | | | | | | | | | | | | |
|---|---|---|---|---|---|---|---|---|---|---|---|---|---|---|---|---|
| | Solid-part image density Toner | | | | Halftone reproducibility Toner | | | | Fog Toner | | | | Carrier attach- | Triboelectric charge ($\mu$C/g) | | |
| | Cy | Y | M | Bk | Cy | Y | M | Bk | Cy | Y | M | Bk | ment | L/L | N/N | H/H |
| Ex. 7 | 1.52 | 1.55 | 1.52 | 1.50 | A | A | A | A | A | A | A | A | A | −30.1 | −29.0 | −27.8 |
| 8 | 1.50 | 1.49 | 1.52 | 1.48 | A | A | A | A | A | A | A | A | A | −30.3 | −28.8 | −27.4 |
| 9 | 1.50 | 1.52 | 1.47 | 1.49 | B | B | B | B | B | B | B | B | B | −31.6 | −29.6 | −27.5 |
| 10 | 1.52 | 1.54 | 1.53 | 1.52 | A | A | A | A | A | A | A | A | B | −28.8 | −27.8 | −26.0 |
| 11 | 1.45 | 1.48 | 1.46 | 1.49 | B | B | B | B | A | A | A | A | A | −32.5 | −31.3 | −29.9 |
| 12 | 1.59 | 1.51 | 1.49 | 1.50 | A | A | A | A | B | B | B | B | B | −30.5 | −28.9 | −27.0 |
| 13 | 1.51 | — | — | — | A | — | — | — | B | — | — | — | A | −35.6 | −34.6 | −32.7 |
| 14 | 1.50 | — | — | — | B | — | — | — | C | — | — | — | A | −31.5 | −30.0 | −28.2 |
| 15 | 1.50 | — | — | — | B | — | — | — | C | — | — | — | A | −30.9 | −29.8 | −27.6 |
| Comp. Ex. 3 | 1.50 | 1.48 | 1.47 | 1.47 | C | C | C | C | D | D | D | D | E | −31.6 | −30.3 | −27.7 |
| 4 | 1.50 | 1.51 | 1.49 | 1.51 | D | D | D | D | E | E | E | E | E | −35.2 | −31.7 | −27.7 |
| 5 | 1.49 | 1.49 | 1.47 | 1.48 | E | E | E | E | E | E | E | E | C | −33.6 | −31.5 | −27.2 |
| Ref. Ex. | 1.51 | — | — | — | A | — | — | — | A | — | — | — | A | −30.0 | −28.8 | −27.6 |

Notes to Tables 3 and 4

The headings in Tables 3 and 4 include the following symbols for indicating toners:

Cy: cyan toner, Y: yellow toner, M: magenta toner and Bk: black toner.

Evaluation results denoted by symbols A–E in Tables 3 and 4 generally represent the following states measured and evaluated according to the manner shown below:

A: excellent, B: good, C: fair, D: rather poor,

E: poor

Evaluation method and standard (1) Image Density

The image density of a solid image portion of an image formed on plain paper was measured as a relative density by using a reflective densitometer equipped with an SPI filter ("Macbeth Color Checker RD-1255", available from Macbeth Co.).

(2) Halftone reproducibility

The roughness of a halftone image portion on a reproduced image was evaluated by comparing it with an original halftone image and several levels of reference reproduced images by eye observation.

(3) Carrier attachment

A solid white image reproduction was interrupted, and a transparent adhesive tape was intimately applied onto a region on the photosensitive drum between the developing station and cleaning station to sample magnetic carrier particles attached to the region. Then, the number of magnetic carrier particles attached onto a size of 5 cm×5 cm were counted to determine the number of attached carrier particles per $cm^2$. The results were evaluated according to the following standard:

A: less than 10 particles/$cm^2$,

B: 10—less than 20 particles/$cm^2$,

C: 20—less than 50 particles/$cm^2$,

D: 50—less than 100 particles/$cm^2$,

E: 100 particles/$cm^2$ or more (4) Fog

An average reflectance Dr (%) of an plane paper before image formation was measured by a densitometer ("TC-6MC", available from Tokyo Denshoku K.K.). Then, a solid white image was formed on an identical plain paper, and an average reflectance Ds (%) of the solid while image was measured in the same manner. Then, Fog (%) was calculated by the following formula:

$$Fog(\%)=Dr(\%)-Ds\ (\%).$$

The results were evaluated according to the following standard:

A: below 1.0%,

B: 1.0—below 1.5%,

C: 1.5—below 2.0%,

D: 2.0—below 3.0%,

E: 3.0% or higher.

What is claimed is:

1. A magnetic coated carrier, comprising:

magnetic coated carrier particles comprising magnetic carrier core particles each comprising a binder resin and metal oxide particles dispersed in the binder resin, and a coating layer surface-coating each carrier core particle, wherein the metal oxide particles consist essentially of (a) ferromagnetic metal oxide particles having been subject to a surface lipophilicity-imparting treatment and (b) non-magnetic metal oxide particles having been subject to a surface lipophilicity-imparting treatment, the non-magnetic metal oxide particles have a higher resistivity than the ferromagnetic metal oxide particles, the magnetic carrier core particles have a resistivity of at least $1\times10^{10}$ ohm.cm, the magnetic coated carrier has a resistivity of at least $1\times10^{12}$ ohm.cm, and the magnetic coated carrier has a particle size distribution such that (i) it has a number-average particle size Dn of 5–100 $\mu$m, (ii) it satisfies a relationship of $Dn/\delta \geqq 3.5$, wherein $\delta$ denotes a standard deviation of number-basis particle size distribution of the carrier, and (iii) it contains at most 25% by number of particles having particle sizes of at most $Dn\times2/3$.

2. The magnetic coated carrier according to claim 1, wherein the binder resin is crosslinked.

3. The magnetic coated carrier according to claim 1, wherein the binder resin comprises a thermosetting resin.

4. The magnetic coated carrier according to claim 1, wherein the coating layer comprises a resin.

5. The magnetic coated carrier according to claim 1, wherein the magnetic carrier core particles have been prepared by polymerization, and the carrier has a shape factor SF-1 of 100–130.

6. The magnetic coated carrier according to claim 1, wherein the metal oxide particles have been lipophilized by at least one species selected from the group consisting of a silane coupling agent, a titanate coupling agent, an aluminum coupling agent and a surface active agent.

7. The magnetic coated carrier according to claim 1, wherein the magnetic carrier core particles comprise at least two species of metal oxide particles in a total amount of 50–99 wt. % including at least one species of ferromagnetic metal oxide particles and another species of non-magnetic metal oxide particles having a higher resistivity than the ferromagnetic metal oxide particles; said another species of metal oxide particles have a number-average particle size which is larger than and at most 5 times that of the ferromagnetic metal oxide particles; and the magnetic coated carrier has a magnetization at 1 kilo-oersted of 40–250 emu/$cm^3$.

8. The magnetic coated carrier according to claim 1, wherein the binder resin of the magnetic carrier core particles comprise a phenolic resin.

9. The magnetic coated carrier according to claim 7, wherein said ferromagnetic metal oxide particles comprise magnetite and said another species of metal oxide particles comprise hematite.

10. The magnetic coated carrier according to claim 7, wherein the metal oxide particles are exposed to the surface of the magnetic coated carrier particles at an average rate of 0.1–10 particles/$\mu m^2$.

11. The magnetic coated carrier according to claim 1, wherein the magnetic coated carrier has a number-average particle size (Dn) of 10–70 $\mu$m.

12. The magnetic coated carrier according to claim 1, wherein the magnetic coated carrier has a shape factor SF-1 of 100–130.

13. The magnetic coated carrier according to claim 1, wherein the magnetic coated carrier contains at most 15% by number of particles having particle sizes of at most Dn×⅔.

14. The magnetic coated carrier according to claim 1, wherein the magnetic coated carrier contains at most 10% by number of particles having particle sizes of at most Dn×⅔.

15. The magnetic coated carrier according to claim 1, wherein the magnetic coated carrier satisfies $Dn/\sigma \geqq 4.0$.

16. The magnetic coated carrier according to claim 7, wherein said ferromagnetic metal oxide particles have a number-average particle size of 0.02–2 $\mu$m.

17. The magnetic coated carrier according to claim 7, wherein said non-magnetic metal oxide particles have a number-average particle size of 0.05–5 $\mu$m.

18. The magnetic coated carrier according to claim 7, wherein said ferromagnetic metal oxide particles have a resistivity of at least $1\times10^3$ ohm.cm.

19. The magnetic coated carrier according to claim 7, wherein said non-magnetic metal oxide particles have a resistivity of at least $1\times10^8$ ohm.cm.

20. The magnetic coated carrier according to claim 7, wherein said non-magnetic metal oxide particles have a resistivity of at least $1\times10^{10}$ ohm.cm.

21. The magnetic coated carrier according to claim 7, wherein the ferromagnetic metal oxide particles occupy 30–95 wt. % of the total metal oxide particles in the magnetic carrier core particles.

22. The magnetic coated carrier according to claim 1, wherein the metal oxide particles have been treated with a silane coupling agent having an amino group.

23. The magnetic coated carrier according to claim 22, wherein said silane coupling agent having an amino group is a compound selected from the group consisting of: γ-aminopropyltrimethoxysilane, γ-aminopropylmethoxydiethoxysilane, N-β-aminoethyl-γ-aminopropyltrimethoxysilane, γ-aminopropylmethyldiethoxysilane, N-β-aminoethyl-γ-aminopropylmethyldimethoxysilane, γ-2-aminoethylaminopropyltrimethoxysilane, and N-phenyl-γ-aminopropyltrimethoxysilane.

24. The magnetic coated carrier according to claim 1, wherein the metal oxide particles have been treated with a silane coupling agent having a hydrophobic group.

25. The magnetic coated carrier according to claim 24, wherein said silane coupling agent having a hydrophobic group is a silane coupling agent having alkyl group, alkenyl group, halogenated alkyl group, halogenated alkenyl group, phenyl group, halogenated phenyl group, or alkyl phenyl group.

26. The magnetic coated carrier according to claim 24, wherein said silane coupling agent having a hydrophobic group comprises an alkoxysilane represented by the following formula: $R_mSiY_n$, wherein R denotes an alkoxy group, Y denotes an alkyl or vinyl group, and m and n are integers of 1–3.

27. The magnetic coated carrier according to claim 24, wherein said silane coupling agent having a hydrophobic group is a compound selected from the group consisting of vinyltrimethoxysilane, vinyltriethoxysilane, vinyltriacetoxysilane, methyltrimethoxysilane, methyltriethoxysilane, isobutyltriethoxysilane, dimethyldimethoxysilane, dimethyldiethoxysilane, trimethylmethoxysilane, n-propyltrimethoxysilane, phenyltrimethoxysilane, n-hexadecyltrimethoxysilane, n-octadecyltrimethoxysilane, and vinyltris(β-methoxy) silane.

28. The magnetic coated carrier according to claim 24, wherein said silane coupling agent having a hydrophobic group is a compound selected from the group consisting of vinyltrichlorosilane, hexamethyldisilazane, trimethylsilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, and chloromethyldimethylchlorosilane.

29. The magnetic coated carrier according to claim 1, wherein the metal oxide particles have been treated with a silane coupling agent having an epoxy group.

30. The magnetic coated carrier according to claim 29, wherein said coupling agent is a compound selected from the group consisting of γ-glycidoxypropylmethyldiethoxysilane, γ-glycidoxypropyltriethoxysilane, and β-(3,4-epoxycyclohexyl)-trimethoxysilane.

31. The magnetic coated carrier according to claim 1, wherein the metal oxide particles have been lipophilicity-imparted by treatment with a silane coupling agent or a titanate coupling agent in an amount of 0.1–10 wt. parts per 100 wt. parts thereof.

32. The magnetic coated carrier according to claim 1, wherein the metal oxide particles have been lipophilicity-imparted by treatment with a silane coupling agent or a titanate coupling agent in an amount of 0.2–6 wt. parts per 100 wt. parts thereof.

33. The magnetic coated carrier according to claim 1, wherein the magnetic coated carrier has a magnetization at 1 kilo-oersted of 40–250 emu/cm$^3$.

34. The magnetic coated carrier according to claim 1, wherein the magnetic coated carrier has a magnetization at 1 kilo-oersted of 50–230 emu/cm$^3$.

35. A two-component type developer for developing an electrostatic image, comprising: a toner and a magnetic coated carrier; wherein the magnetic coated carrier comprises magnetic coated carrier particles comprising magnetic carrier core particles each comprising a binder resin and metal oxide particles dispersed in the binder resin, and a coating layer surface-coating each carrier core particle, wherein the metal oxide particles consist essentially of (a) ferromagnetic metal oxide particles having been subject to a surface lipophilicity-imparting treatment and (b) non-magnetic metal oxide particles having been subject to a surface lipophilicity-imparting treatment, the non-magnetic metal oxide particles have a higher resistivity than the ferromagnetic metal oxide particles, the magnetic carrier core particles have a resistivity of at least $1\times10^{10}$ ohm.cm, the magnetic coated carrier has a resistivity of at least $1\times10^{12}$ ohm.cm, and the magnetic coated carrier has a particle size distribution such that (i) it has a number-average particle size Dn of 5–100 μm, (ii) it satisfies a relationship of $Dn/\delta \geqq 3.5$, wherein δ denotes a standard deviation of number-basis particle size distribution of the carrier, and (iii) it contains at most 25% by number of particles having particle sizes of at most $Dn\times2/3$.

36. The developer according to claim 35, wherein the toner has a weight-average particle size (D4) of 1–10 μm.

37. The developer according to claim 35, wherein the toner has a weight-average particle size of 3–8 μm.

38. The developer according to claim 35, wherein the toner contains at most 20% by number of toner particles having sizes of at most a half its number-average particle size (D1) and contains at most 10% by volume of toner particles having sizes of at last two times its weight-average particle size (D4).

39. The developer according to claim 35, wherein the magnetic coated carrier has a number-average particle size (Dn) of 15–50 μm, and the toner has a weight-average particle size (D4) of 3–8.

40. The developer according to claim 35, wherein the toner has a shape factor SF-1 of 100–140, and a residual monomer content of at most 1000 rpm.

41. The developer according to claim 40, wherein the toner has a residual monomer content of at most 500 ppm.

42. The developer according to claim 35, wherein the toner has a shape factor SF-1 of 100–130, and a residual monomer content of at most 300 rpm.

43. The developer according to claim 35, wherein the toner comprises toner particles each having a core/shell structure.

44. The developer according to claim 43, wherein each toner particle has a core comprising a low-softening point substance, which has a melting point of 40–90° C.

45. The developer according to claim 44, wherein the toner particles contain 5–30 wt. % thereof of the low-softening point substance.

46. The developer according to claim 35, wherein the toner comprises toner particles and a powdery external additive having a number-average particle size of at most 0.2 μm.

47. The developer according to claim 46, wherein the external additive is contained in an amount of 0.01–10 wt. parts per 100 wt. parts of the toner particles.

48. The developer according to claim 46, wherein the external additive is contained in an amount of 0.05–5 wt. parts per 100 wt. parts of the toner particles.

49. The developer according to claim 35, wherein the toner has a triboelectric chargeability of 5–100 μC/g in terms of an absolute value.

50. The developer according to claim 35, wherein the toner has a triboelectric chargeability of 5–60 μC/g in terms of an absolute value.

51. The developer according to claim 35, wherein the binder resin is crosslinked.

52. The developer according to claim 35, wherein the binder resin comprises a thermosetting resin.

53. The developer according to claim 35, wherein the coating layer comprises a resin.

54. The developer according to claim 35, wherein the magnetic carrier core particles have been prepared by polymerization, and the carrier has a shape factor SF-1 of 100–130.

55. The developer according to claim 35, wherein the metal oxide particles have been lipophilized by at least one species selected from the group consisting of a silane coupling agent, a titanate coupling agent, an aluminum coupling agent and a surface active agent.

56. The developer according to claim 35, wherein the magnetic carrier core particles comprise at least two species of metal oxide particles in a total amount of 50–99 wt. % including at least one species of ferromagnetic metal oxide particles and another species of non-magnetic metal oxide particles having a higher resistivity than the ferromagnetic metal oxide particles; said another species of metal oxide particles have a number-average particle size which is larger than and at most 5 times that of the ferromagnetic metal oxide particles; and the magnetic coated carrier has a magnetization at 1 kilo-oersted of 40–250 emu/cm$^3$.

57. The developer according to claim 35, wherein the binder resin of the magnetic carrier core particles comprise a phenolic resin.

58. The developer according to claim 35, wherein said ferromagnetic metal oxide particles comprise magnetite and said another species of metal oxide particles comprise hematite.

59. The developer according to claim 56, wherein the metal oxide particles are exposed to the surface of the magnetic coated carrier particles at an average rate of 0.1–10 particles/μm$^2$.

60. The developer according to claim 35, wherein the magnetic coated carrier has a number-average particle size (Dn) of 10–70 μm.

61. The developer according to claim 35, wherein the magnetic coated carrier has a shape factor SF-1 of 100–130.

62. The developer according to claim 35, wherein the magnetic coated carrier contains at most 15% by number of particles having particle sizes of at most $Dn\times2/3$.

63. The developer according to claim 35, wherein the magnetic coated carrier contains at most 10% by number of particles having particle sizes of at most $Dn\times2/3$.

64. The developer according to claim 35, wherein the magnetic coated carrier satisfies $Dn/\sigma \geqq 4.0$.

65. The developer according to claim 56, wherein said ferromagnetic metal oxide particles have a number-average particle size of 0.02–2 μm.

66. The developer according to claim 56, wherein said non-magnetic metal oxide particles have a number-average particle size of 0.05–5 μm.

67. The developer according to claim 56, wherein said ferromagnetic metal oxide particles have a resistivity of at least $1\times10^3$ ohm.cm.

68. The developer according to claim 56, wherein said non-magnetic metal oxide particles have a resistivity of at least $1\times10^8$ ohm.cm.

69. The developer according to claim 56, wherein said non-magnetic metal oxide particles have a resistivity of at least $1\times10^{10}$ ohm.cm.

70. The developer according to claim 56, wherein the ferromagnetic metal oxide particles occupy 30–95 wt. % of the total metal oxide particles in the magnetic carrier core particles.

71. The developer according to claim 35, wherein the metal oxide particles have been treated with a silane coupling agent having an amino group.

72. The developer according to claim 71, wherein said silane coupling agent having an amino group is a compound selected from the group consisting of: γ-aminopropyltrimethoxysilane, γ-aminopropylmethoxydiethoxysilane, N-β-aminoethyl-γ-aminopropyltrimethoxysilane, γ-aminopropylmethyldiethoxysilane, N-β-aminoethyl-γ-aminopropylmethyldimethoxysilane, γ-2-aminoethylaminopropyltrimethoxysilane, and N-phenyl-γ-aminopropyltrimethoxysilane.

73. The developer according to claim 35, wherein the metal oxide particles have been treated with a silane coupling agent having a hydrophobic group.

74. The developer according to claim 73, wherein said silane coupling agent having a hydrophobic group is a silane coupling agent having alkyl group, alkenyl group, halogenated alkyl group, halogenated alkenyl group, phenyl group, halogenated phenyl group, or alkyl phenyl group.

75. The developer according to claim 73, wherein said silane coupling agent having a hydrophobic group comprises an alkoxysilane represented by the following formula: $R_mSiY_n$, wherein R denotes an alkoxy group, Y denotes an alkyl or vinyl group, and m and n are integers of 1–3.

76. The developer according to claim 73, wherein said silane coupling agent having a hydrophobic group is a compound selected from the group consisting of vinyltrimethoxysilane, vinyltriethoxysilane, vinyltriacetoxysilane, methyltrimethoxysilane, methyltriethoxysilane, isobutyltriethoxysilane, dimethyldimethoxysilane, dimethyldiethoxysilane, trimethylmethoxysilane, n-propyltrimethoxysilane, phenyltrimethoxysilane, n-hexadecyltrimethoxysilane, n-octadecyltrimethoxysilane, and vinyltris(β-methoxy)-silane.

77. The developer according to claim 73, wherein said silane coupling agent having a hydrophobic group is a compound selected from the group consisting of vinyltrichlorosilane, hexamethyldisilazane, trimethylsilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, and chloromethyldimethylchlorosilane.

78. The developer according to claim 35, wherein the metal oxide particles have been treated with a silane coupling agent having an epoxy group.

79. The developer according to claim 78, wherein said coupling agent is a compound selected from the group consisting of γ-glycidoxy-propylmethyldiethoxy-silane, γ-glycidoxypropyl-triethoxysilane, and β-(3,4-epoxycyclohexyl)-trimethoxysilane.

80. The developer according to claim 35, wherein the metal oxide particles have been lipophilicity-imparted by treatment with a silane coupling agent or a titanate coupling agent in an amount of 0.1–10 wt. parts per 100 wt. parts thereof.

81. The developer according to claim 35, wherein the metal oxide particles have been lipophilicity-imparted by treatment with a silane coupling agent or a titanate coupling agent in an amount of 0.2–6 wt. parts per 100 wt. parts thereof.

82. The developer according to claim 35, wherein the magnetic coated carrier has a magnetization at 1 kilo-oersted of 40–250 emu/cm$^3$.

83. The developer according to claim 35, wherein the magnetic coated carrier has a magnetization at 1 kilo-oersted of 50–230 emu/cm$^3$.

84. A developing method, comprising: carrying a two-component type developer on a developer-carrying member enclosing therein a magnetic field generating means, forming a magnetic brush of the two-component type developer on the developer-carrying member, causing the magnetic brush to contact an image-bearing member, and developing an electrostatic image on the image-bearing member while applying an alternating electric field to the developer-carrying member;

wherein the two-component type developer comprises a toner and a magnetic coated carrier;

wherein the magnetic coated carrier comprises magnetic coated carrier particles comprising magnetic carrier core particles each comprising a binder resin and metal oxide particles dispersed in the binder resin, and a coating layer surface-coating each carrier core particle, wherein the metal oxide particles consist essentially of (a) ferromagnetic metal oxide particles having been subject to a surface lipophilicity-imparting treatment and (b) non-magnetic metal oxide particles having been subject to a surface lipophilicity-imparting treatment, the non-magnetic metal oxide particles have a higher resistivity than the ferromagnetic metal oxide particles, the magnetic carrier core particles have a resistivity of at least $1\times10^{10}$ ohm.cm, the magnetic coated carrier has a resistivity of at least $1\times10^{12}$ ohm.cm, and the magnetic coated carrier has a particle size distribution such that (i) it has a number-average particle size Dn of 5–100 μm, (ii) it satisfies a relationship of $Dn/\sigma \geqq 3.5$, wherein σ denotes a standard deviation of number-basis particle size distribution of the carrier, and (iii) it contains at least 25% by number of particles having particle sizes of at most $Dn\times2/3$.

85. The method according to claim 84, wherein the alternating electric field has a peak-to-peak voltage of 500–5000 volts and a frequency of 500–10,000 Hz.

86. The method according to claim 85, wherein the alternating electric field has a frequency of 500–3000 Hz.

87. The method according to claim 84, wherein said developer-carrying member and said image-bearing member are disposed with a minimum spacing therebetween of 100–1000 μm.

88. The method according to claim 84, wherein said two-component type developer is a developer according to any one of claims 32–66.

89. The method according to claim 84, wherein the developer carrying member has a surface unevenness satisfying the following conditions: 0.2 μm≦center line-average roughness (Ra)≦5.0 μm, 10 μm≦average unevenness spacing (Sm)≦80 μm and 0.05≦Ra/Sm≦0.5.

* * * * *

UNITED STATES PATENT AND TRADEMARK OFFICE

CERTIFICATE OF CORRECTION

PATENT NO. : 6,165,663
DATED : December 26, 2000
INVENTOR(S) : Yoshinobu Baba et al.

It is certified that error appears in the above-identified patent and that said Letters Patent is hereby corrected as shown below:

Column 1,
Line 5, "Appln" should read -- application --;
Line 6, "1997 Abnd." should read -- 1997, now abandoned. --; and
Line 22, "without," should read -- without --.

Column 2,
Line 51, "capable" should read -- capable of --.

Column 4,
Line 35, "well" should read -- effectively --.

Column 5,
Line 11, "faction" should read -- fraction --; and
Line 66, "is" should read -- be --.

Column 8,
Line 9, "has" should read -- have --; and
Line 22, "and" should read -- are --.

Column 9,
Line 62, "azobisisobutylonitrile;" should read -- azobisisobutyronitrile --.

Column 10,
Line 25, "are" should read -- be --;
Line 44, "particles/$\mu$m," should read -- particles/$\mu m^2$, --; and
Line 45, particles/$\mu$m" should read -- particles/$m^2$ -- and "well" should read -- effectively --.

Column 12,
Line 59, "has" should read -- have --; and
Line 67, "has" should read -- have --.

Column 13,
Line 1, "has" should read -- have --; and
Line 40, "result" should read -- result in resin decomposition products and low-molecular --.

Column 14,
Line 33, "comprises" should read -- comprise --.

UNITED STATES PATENT AND TRADEMARK OFFICE

CERTIFICATE OF CORRECTION

PATENT NO. : 6,165,663
DATED : December 26, 2000
INVENTOR(S) : Yoshinobu Baba et al.

It is certified that error appears in the above-identified patent and that said Letters Patent is hereby corrected as shown below:

Column 15,
Line 19, "qualities" should read -- quality --;
Line 20, "characteristic." should read -- characteristics. --; and
Line 46, "the" (first occurrence) should be deleted.

Column 18,
Line 11, "an" should read -- and --;
Line 43, "compound" should read -- compounds --;
Line 44, "compound" should read -- compounds --; and
Line 59, "azobisisobutylonitrile;" should read -- azobisisobutyronitrile; --.

Column 22,
Line 63, "alone" should read -- alone in --.

Column 23,
Line 21, "is" should read -- are --; and
Line 31, "four-types" should read -- four types --.

Column 24,
Line 28, "un-fixed" should read -- unfixed --; and
Line 43, "a" (second occurrence) should read -- $\sigma$ --.

Column 25,
Line 52, "(total resin content 9] x 100 (%)" should read -- (total resin content 9)] x 100 (%) --; and
Line 62, "Particle" should read -- Particles --.

Column 29,
Line 29, "was" should read -- were --; and
Line 55, "emu/cm$^{3}$'" should read -- emu/cm$^{3}$, --.

Column 30,
Line 31, "emu/cm$^{3}$'" should read -- emu/cm$^{3}$, --; and
Line 45, ""un-coated" should read -- uncoated --.

Column 31,
Line 54, "Tm.p." should read -- Tmp. --.

Column 32,
Line 50, "ester" should read -- ester, which --; and
Line 62, "obtaining" should read -- obtain --.

UNITED STATES PATENT AND TRADEMARK OFFICE

CERTIFICATE OF CORRECTION

PATENT NO. : 6,165,663
DATED : December 26, 2000
INVENTOR(S) : Yoshinobu Baba et al.

It is certified that error appears in the above-identified patent and that said Letters Patent is hereby corrected as shown below:

Column 34,
Line 6, "part" should read -- parts --;
Line 20, "part" should read -- parts --;
Line 34, "part" should read -- parts --; and
Table 2, "013" should read -- 103 --.

Column 38,
Line 45, "Example 4" should read -- Example 5 --.

Column 41,
Table 4, "Comp." should read -- Comp. --; and

| | |
|---|---|
| Ex. 3 | Ex. 4 |
| 4 | 5 |
| 5 | 6 |

Line 64, "an" should read -- a --.

Column 43,
Line 26, "comprise" should read -- comprises --; and
Line 30, "comprise" should read -- comprises --.

Column 46,
Line 39, "comprise" should read -- comprises --; and
Line 43, "comprise" should read -- comprises --.

Column 48,
Line 36, "have" should read -- having --.

Signed and Sealed this

Twenty-ninth Day of January, 2002

*Attest:*

*Attesting Officer*

JAMES E. ROGAN
*Director of the United States Patent and Trademark Office*